US010137706B2

(12) United States Patent
Takei et al.

(10) Patent No.: US 10,137,706 B2
(45) Date of Patent: Nov. 27, 2018

(54) RECORDING APPARATUS

(71) Applicant: SEIKO EPSON CORPORATION, Tokyo (JP)

(72) Inventors: Atsushi Takei, Nagano (JP); Yoshikane Tsuchihashi, Nagano (JP); Yu Shinagawa, Nagano (JP); Mitsuhiro Koseki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/694,127

(22) Filed: Sep. 1, 2017

(65) Prior Publication Data

US 2018/0086110 A1 Mar. 29, 2018

(30) Foreign Application Priority Data

Sep. 26, 2016 (JP) ..... 2016-187219

(51) Int. Cl.

| | |
|---|---|
| ***B41J 2/01*** | (2006.01) |
| ***B41J 11/00*** | (2006.01) |
| ***B41J 25/00*** | (2006.01) |
| ***B41J 2/21*** | (2006.01) |
| ***B41J 13/00*** | (2006.01) |
| *B41J 11/54* | (2006.01) |

(52) U.S. Cl.

CPC ..... *B41J 11/008* (2013.01); *B41J 2/01* (2013.01); *B41J 2/2132* (2013.01); *B41J 11/0095* (2013.01); *B41J 13/0027* (2013.01); *B41J 25/001* (2013.01); *B41J 11/54* (2013.01)

(58) Field of Classification Search

CPC . B41J 2/01; B41J 2/2132; B41J 11/008; B41J 11/0095; B41J 13/0027; B41J 25/001

See application file for complete search history.

(56) References Cited

U.S. PATENT DOCUMENTS 6,527,360 B2 * 3/2003 Otsuki ..... B41J 2/185 347/14

FOREIGN PATENT DOCUMENTS

| | | | |
|---|---|---|---|
| JP | 07-047726 | A | 2/1995 |
| JP | 2002-292851 | A | 10/2002 |
| JP | 2005-280214 | A | 10/2005 |
| JP | 2010-046883 | A | 3/2010 |
| JP | 2013-049152 | A | 3/2013 |

* cited by examiner

*Primary Examiner* — Thinh H Nguyen

(57) ABSTRACT

A recording apparatus includes a recording head that includes a nozzle row which is provided with a plurality of nozzles discharging liquid to a medium along a transporting direction, and executes recording as one pass by discharging the liquid from the nozzles in accordance with movement in a scanning direction intersecting the transporting direction, a transporting unit that transports the medium to a position facing the nozzle row, and a controller that is capable of acquiring information relating to a length of the medium in the transporting direction and controls the recording head and the transporting unit, in which the controller determines the nozzle being used for a recording operation as one pass in the beginning in accordance with the acquired length of the medium, and executes a heading operation for feeding the medium to a position facing the determined nozzle.

8 Claims, 18 Drawing Sheets

RECORDING APPARATUS

INCORPORATED BY REFERENCE

The entire disclosure of Japanese Patent Application No. 2016-187219, filed Sep. 26, 2016 is expressly incorporated by reference herein.

BACKGROUND

1. Technical Field

The present disclosure relates to a recording apparatus which executes recording on a medium.

2. Related Art

As an ink jet printer which is an example of a recording apparatus, there is a so-called serial type printer which is a type of printer that executes recording by alternately operating a transporting operation of recording paper as an example of a medium and an ink discharging operation for discharging ink from a recording head.

When the transporting operation of the recording paper is executed, there is a case in which a transportation load (back tension) is applied to the recording paper due to a configuration of a paper transportation path, and a desired amount of paper being fed cannot be obtained due to the back tension. For example, in a case in which a paper feeding roller on an upstream side and a paper feeding roller on a downstream side are provided, if the amount of paper being fed by the paper feeding roller on the upstream side is not sufficient, the paper feeding roller on the downstream side pulls the paper, and as a result, the accuracy of paper feeding is deteriorated by the paper feeding roller on the downstream side.

From the related art, controlling is performed so as to obtain the desired amount of paper being fed using a correction value for correcting the amount of paper being fed.

As an example thereof, a recording apparatus disclosed in JP-A-2010-046883 is configured to correct an amount of a transporting roller pair driven based on a correction value set in accordance with a position of a rear end of a medium. Accordingly, even when a level of a back tension set in accordance with the position of the rear end of the medium is changed, it becomes possible to cope with the change. Particularly, in the recording apparatus disclosed in JP-A-2010-046883, since the amount of the transporting roller pair driven is corrected depending on the position of the rear end of the medium in a U-shaped medium feeding path, an additional action effect can be obtained in a configuration using the U-shaped medium feeding path where the change of the level of the back tension is likely to increase.

However, in an ink jet recording apparatus, in many cases, it can be said that a back tension applied to the medium decreases as a rear end of a medium is positioned on further downstream side. It is because a transportation path region (recording region) facing a recording head and transportation path regions in the upstream and downstream vicinities thereof are essentially linearly configured. For example, in the configuration disclosed in JP-A-2010-046883, as the rear end of a medium is positioned on the further downstream side, the medium is come out from a U-shaped transportation path section, and a back tension becomes smaller.

Meanwhile, as in the configuration disclosed in JP-A-2010-046883, it is also considered that the influence of the back tension is reduced by correcting an amount of the transporting roller pair driven; however, in a state in which a rear end of the medium is not come out from the U-shaped transportation path section, the back tension being applied to the medium causes the slip or the like of the transporting roller pair, and a better recording result cannot be obtained. That is, the correction of the amount of the transporting roller pair driven has a limit as a measure for obtaining a better recording result.

SUMMARY

An advantage of some aspects of the disclosure is to provide a recording apparatus which includes a back tension measure which can be selected instead of correcting the amount of the transporting roller pair driven or in addition to correcting the amount of the transporting roller pair driven and is thus capable of obtaining a better recording result.

According to a first aspect of the disclosure, there is provided a recording apparatus including a recording head that includes a nozzle row which is provided with a plurality of liquid discharging nozzles discharging liquid to a medium along a medium transporting direction, and executes recording as one pass by discharging the liquid from the liquid discharging nozzles in accordance with movement in a scanning direction intersecting the medium transporting direction, a transporting unit that transports the medium to a recording position which is a position facing the nozzle row, and a controller that is capable of acquiring information relating to a length of the medium in the medium transporting direction, and controls the recording head and the transporting unit, in which the controller determines the liquid discharging nozzle being used for a recording operation as one pass in the beginning in accordance with the acquired length of the medium in the medium transporting direction, and executes a heading operation feeding the medium to a position facing the determined liquid discharging nozzle.

According to the aspect, since the controller determines the liquid discharging nozzle used for the recording operation as the one pass in the beginning in accordance with the length of the medium in the medium transporting direction, and executes the heading operation for feeding the medium to a position facing the determined liquid discharging nozzle, in a case in which the rear end of the medium is in a region where the back tension is generated, in a state in which influence of the back tension is avoided or reduced by executing heading so as to feed the medium to the further downstream side, liquid can be discharged from the liquid discharging nozzle. As a result, a better recording result can be obtained.

According to a second aspect of the disclosure, in the first aspect, the recording apparatus further includes a transportation load applying portion that applies transportation load to the medium in a medium transportation path on the upstream side by the transporting unit, in which the controller is capable of selecting a first heading mode, and a second heading mode in which the number of the liquid discharging nozzles facing the medium by the first heading mode increases, as the heading operation, and in which the second heading mode is a heading mode in which a rear end of the medium is transmitted through the transportation load applying portion in a case in which the rear end of the medium is determined to be caught by the transportation load applying portion when the first heading mode is selected.

According to the aspect, the first heading mode and the second heading mode are provided, the second heading mode is the heading mode in which the rear end of the medium is transmitted through the transportation load applying portion in a case in which the rear end of the medium is determined to be caught by the transportation load applying portion when the first heading mode is selected, and thus in a state in which the influence of the back tension is avoided or reduced by selecting the second heading mode, liquid can be discharged from the liquid discharging nozzle. As a result, the better recording result can be obtained.

According to a third aspect of the disclosure, in the second aspect, the recording operation as one pass in the beginning is a recording operation as one pass in the beginning in a recording mode in which recording as one pass by the recording head and feeding of the medium by the transporting unit are alternately executed, and contents of the recording are completed by executing the recording as the one pass n times.

According to a fourth aspect of the disclosure, in the third aspect, the first heading mode is a mode in which medium faces the liquid discharging nozzles as the number obtained by dividing the number of the liquid discharging nozzles of the nozzle row in the medium transporting direction by n, and the second heading mode is a mode in which the medium faces the liquid discharging nozzles more than the number obtained by dividing the number of the liquid discharging nozzles of the nozzle row in the medium transporting direction by n.

According to a fifth aspect of the disclosure, in the fourth aspect, the controller executes the second heading mode, and an amount of the medium fed by the transporting unit after recording as the one pass in the beginning is executed is close to an amount of the medium fed by the transporting unit after the first heading mode is executed.

According to a sixth aspect of the disclosure, in any one of the second aspect to the fifth aspect, the transportation load applying portion includes a pair of rollers including a feeding roller which feeds a medium, and a separating roller which nips the medium between the separating roller and the feeding roller and receives a rotational resistance.

According to a seventh aspect of the disclosure, in any one of the second aspect to the fifth aspect, in the recording apparatus disclosed, the transportation load applying portion includes a curved path through which the medium is bent and transported.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Hereinafter, embodiments of the disclosure will be described with reference to drawings. Also, the same numeral is given to the same configuration in each example, only a first example will be described, and description of configurations in following examples will be omitted.

Figure 1:
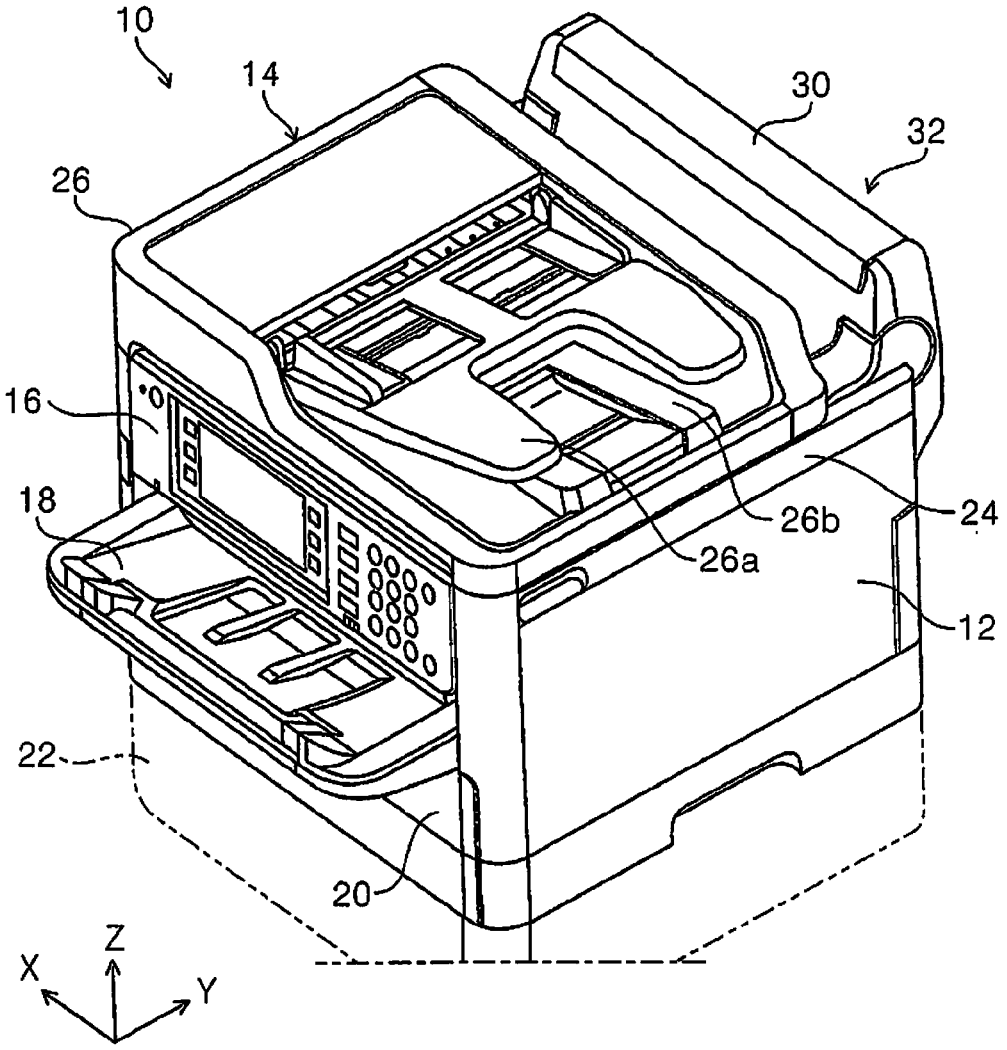
FIG. 1 is an exterior perspective view of a printer according to the disclosure.
Figure 2:
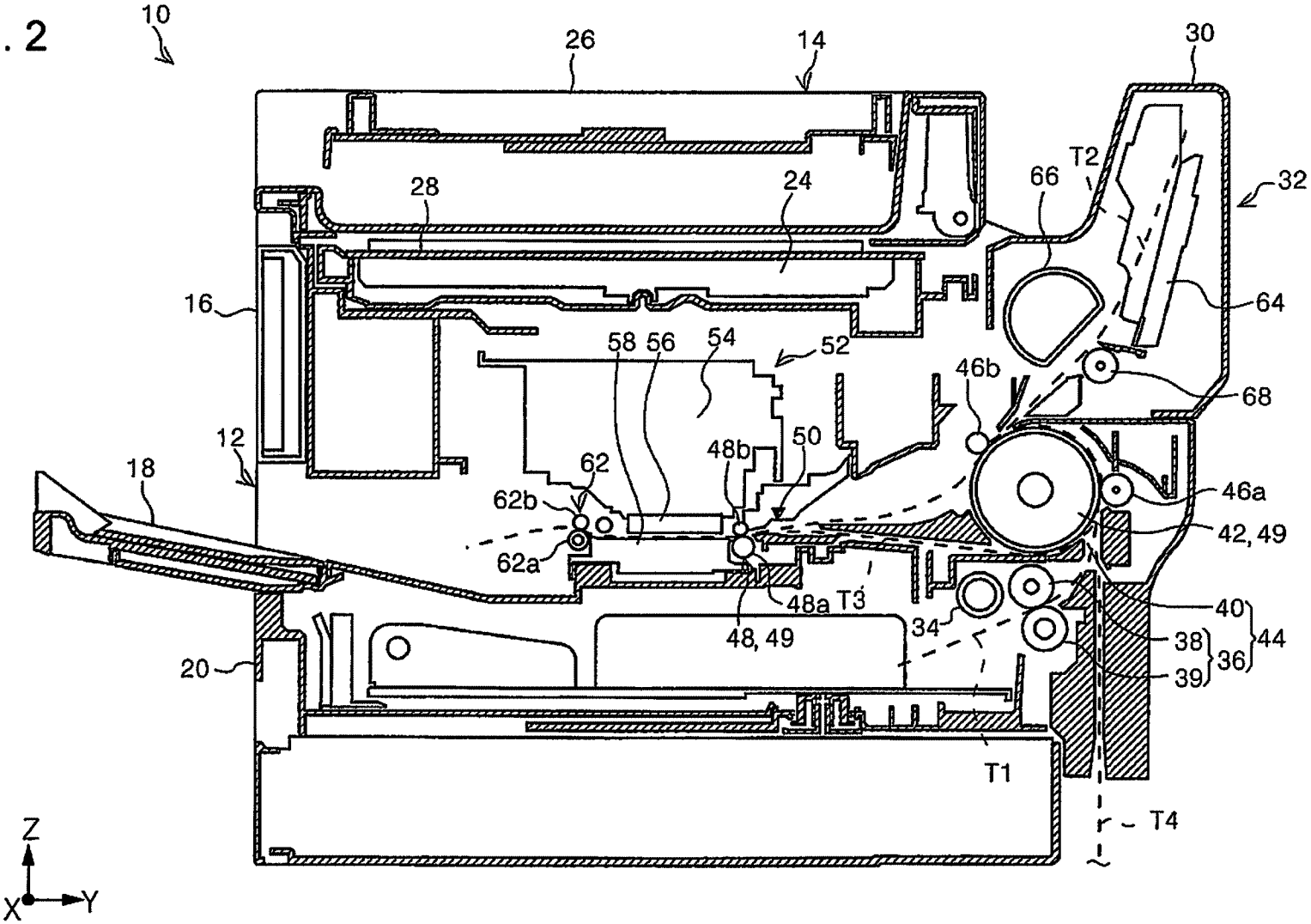
FIG. 2 is a side sectional view of a transportation path of a medium in the printer.
Figure 3:
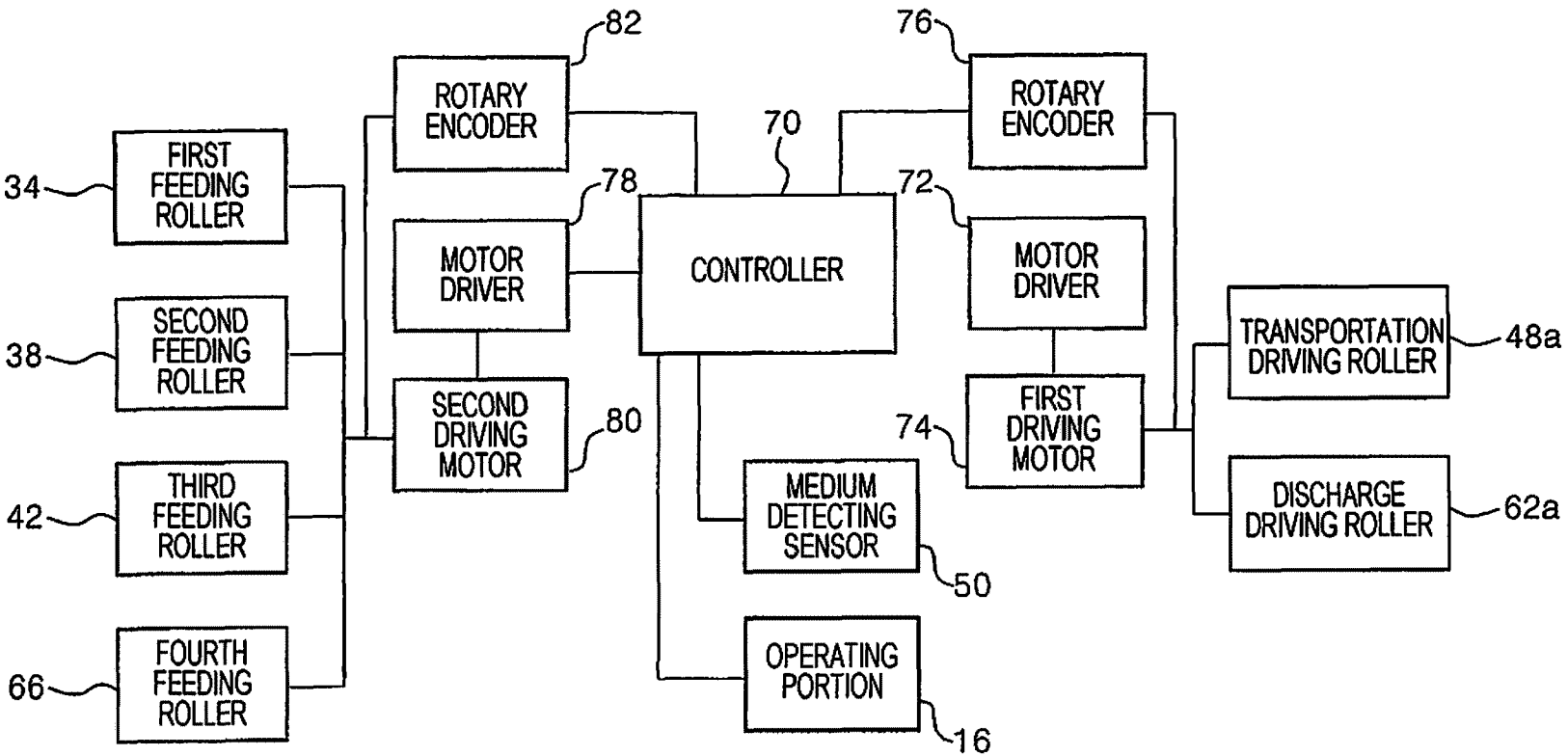
FIG. 3 is a block diagram of a controller and a target to be controlled in the printer according to the disclosure.
Figure 4:
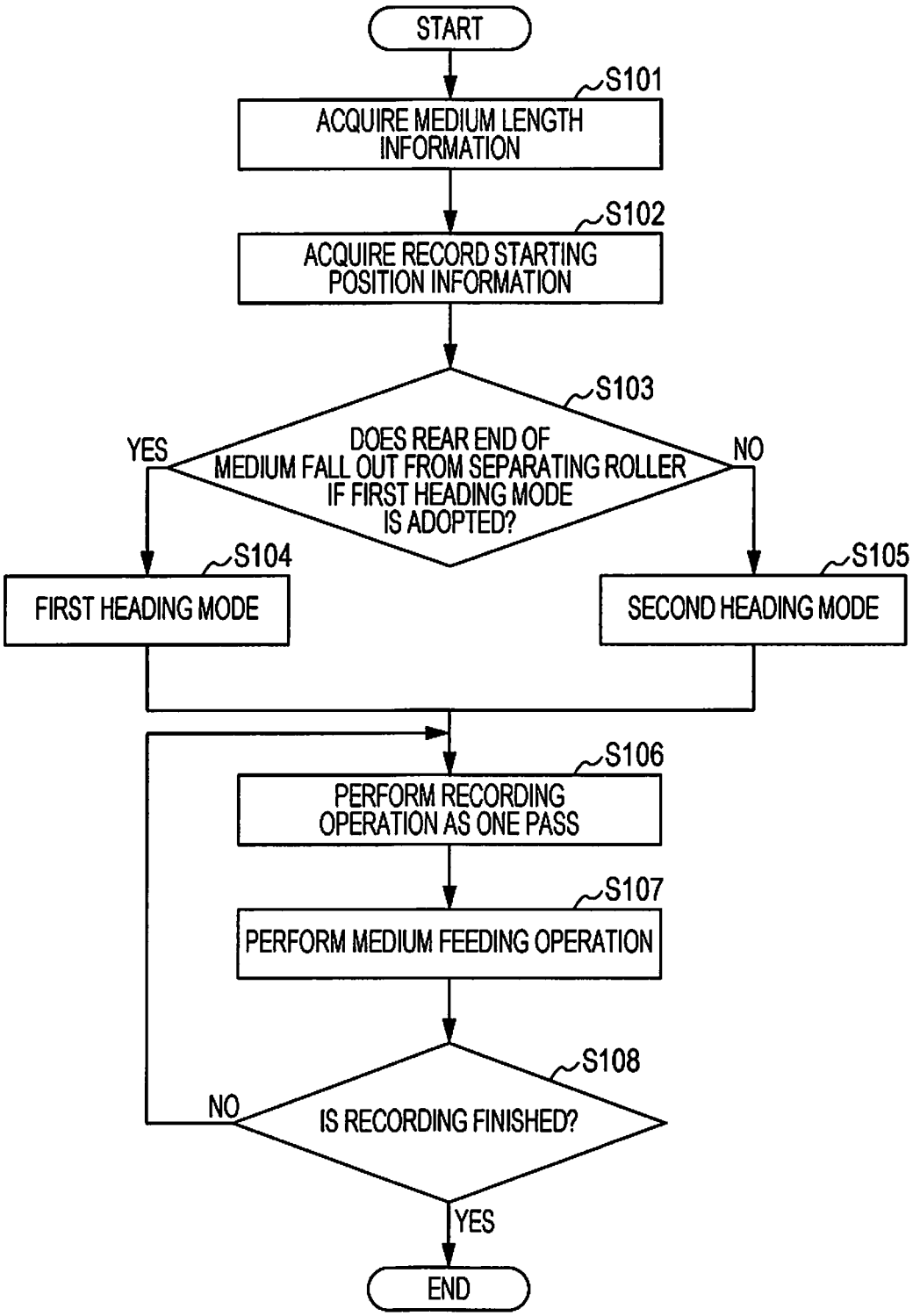
FIG. 4 is a flow chart of selection of a first heading mode and a second heading mode.
Figure 5:
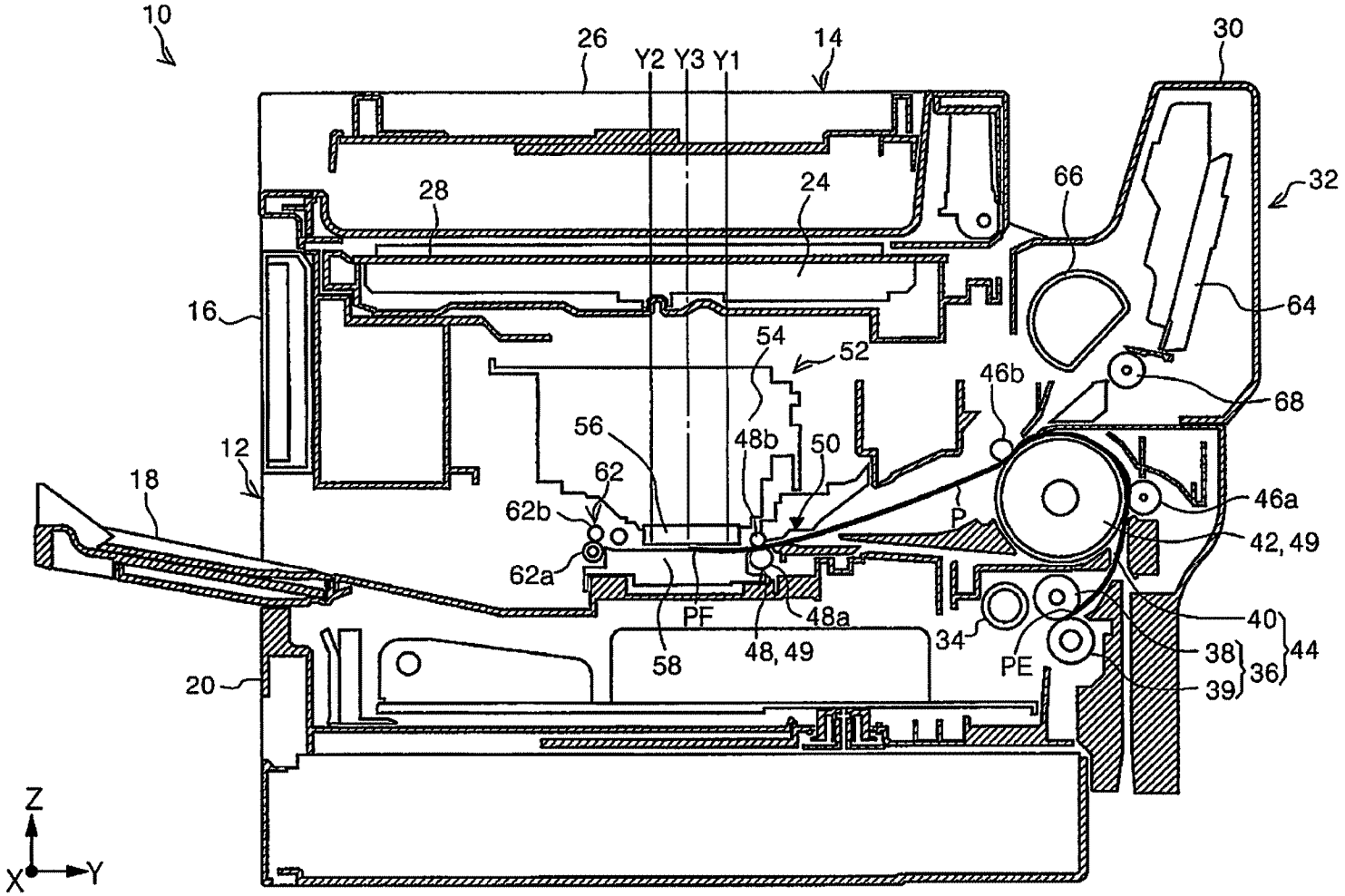
FIG. 5 is a side sectional view of a medium transportation path indicating a state in which a rear end of a medium does not come out of a first separating roller at a heading operation completed timing.
Figure 6:
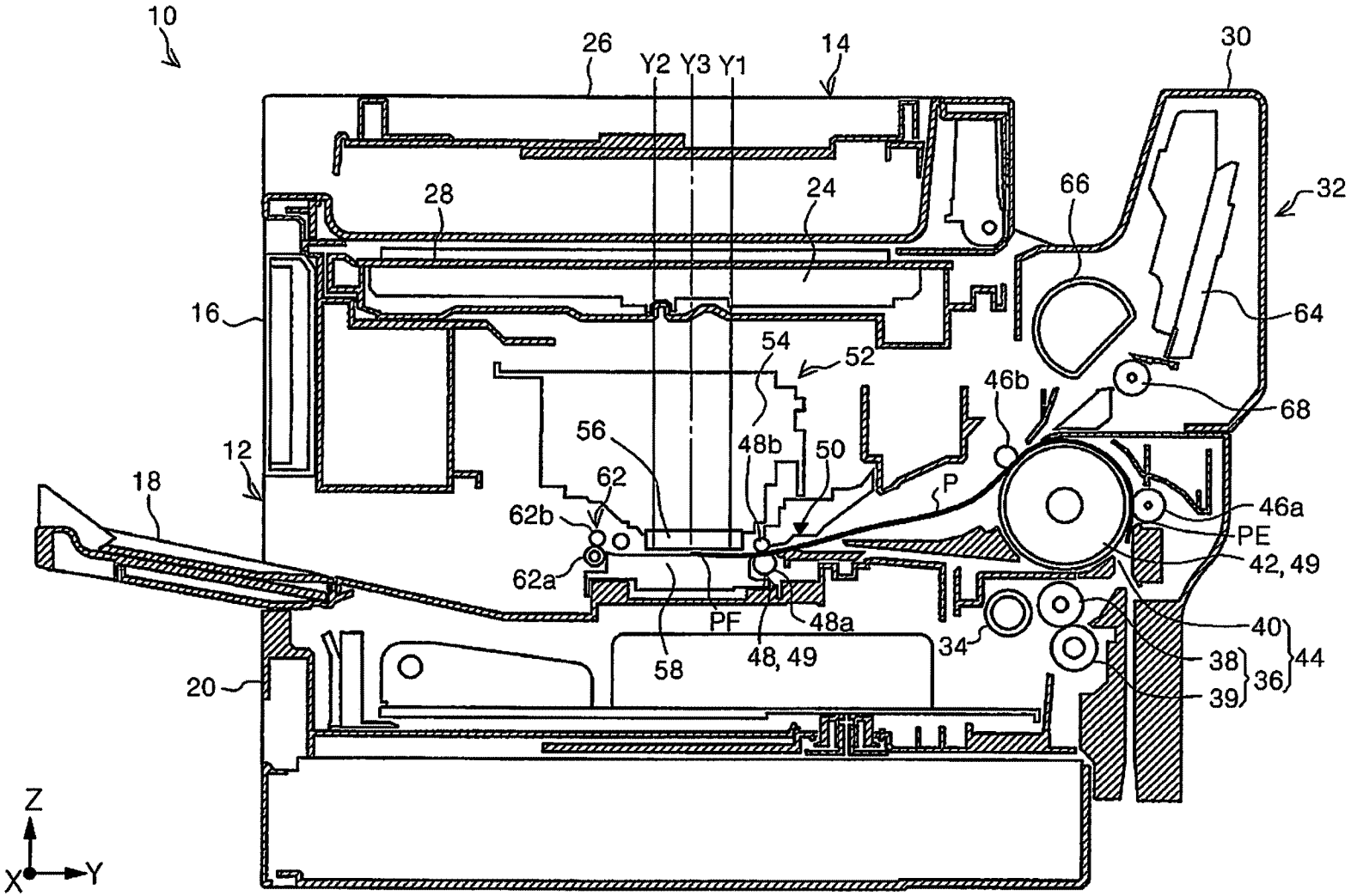
FIG. 6 is a side sectional view of the medium transportation path indicating a state in which the rear end of the medium comes out of the first separating roller at the heading operation completed timing.

FIG. 1 is an exterior perspective view of a printer according to the disclosure, FIG. 2 is a side sectional view of a transportation path of a medium in the printer, FIG. 3 is a block diagram of a controller and a target to be controlled in the printer according to the disclosure, FIG. 4 is a flow chart of selection of a first heading mode and a second heading mode, FIG. 5 is a side sectional view of a medium transportation path indicating a state in which a rear end of a medium does not come out of a first separating roller at a heading operation completed timing, and FIG. 6 is a side sectional view of the medium transportation path indicating a state in which the rear end of the medium comes out of the first separating roller at the heading operation completed timing.

Figure 7:
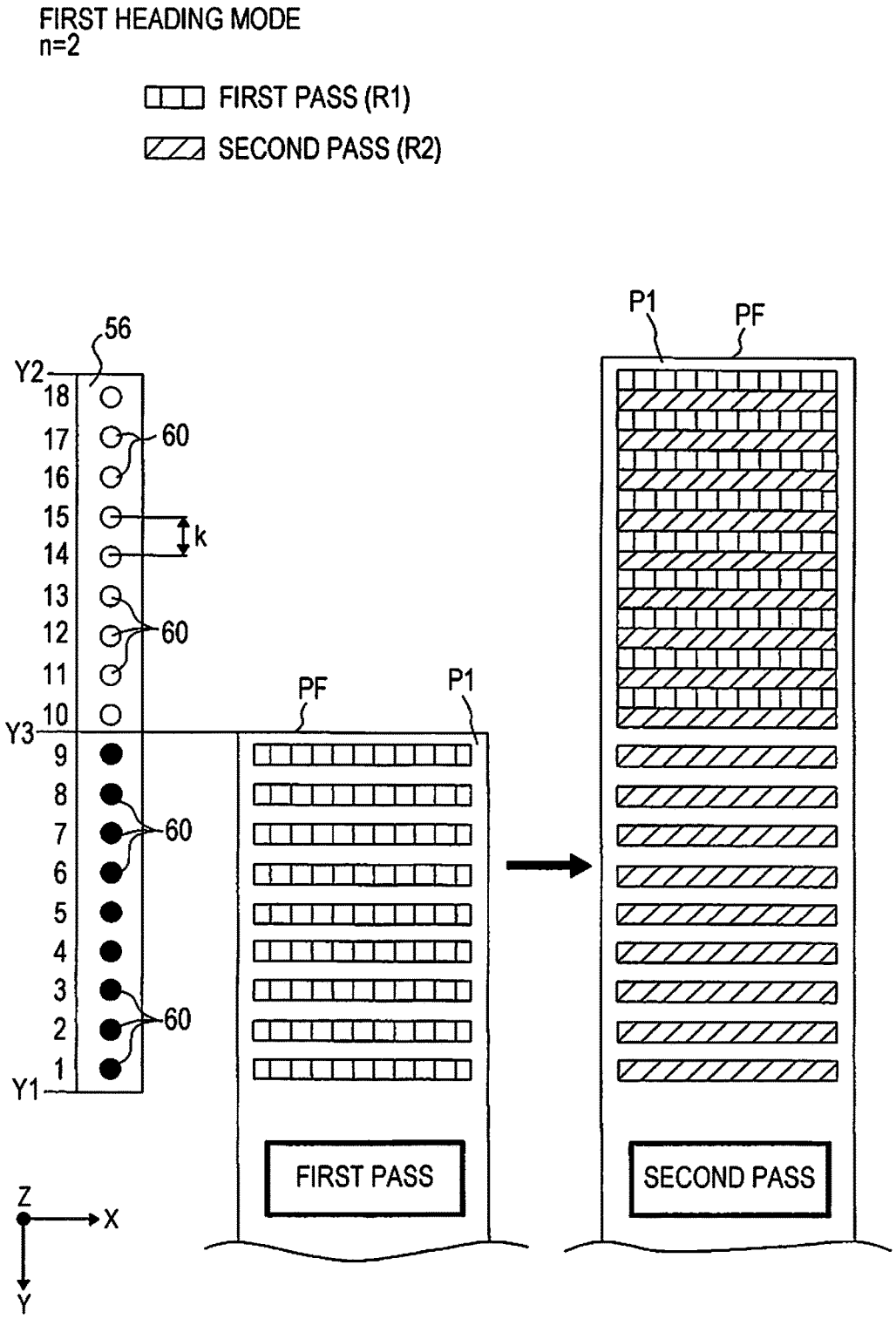
FIG. 7 is a schematic view of an image forming state of a first pass and a second pass of the first heading mode.
Figure 8:
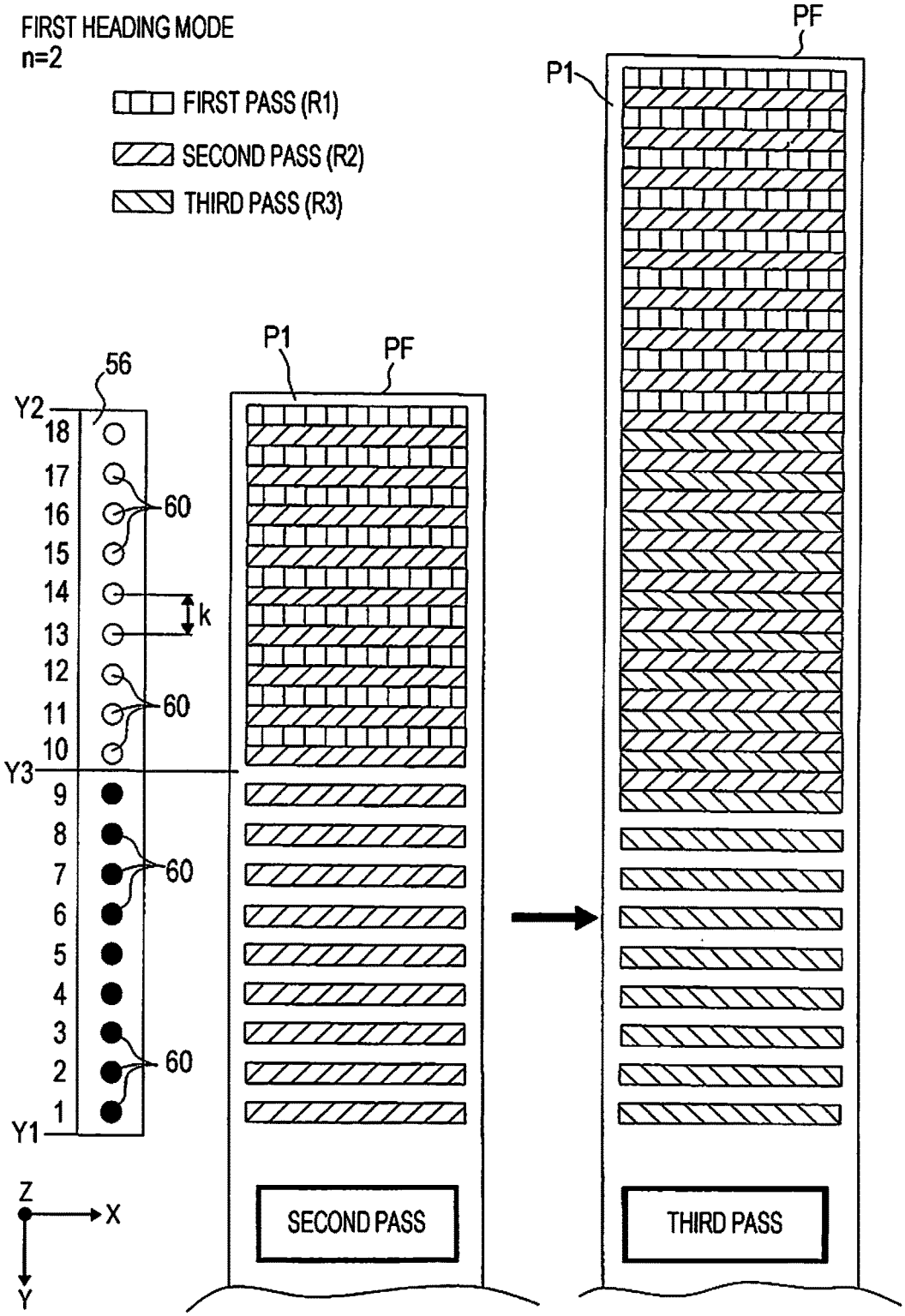
FIG. 8 is a schematic view of the image forming state of the second pass and a third pass of the first heading mode.
Figure 9:
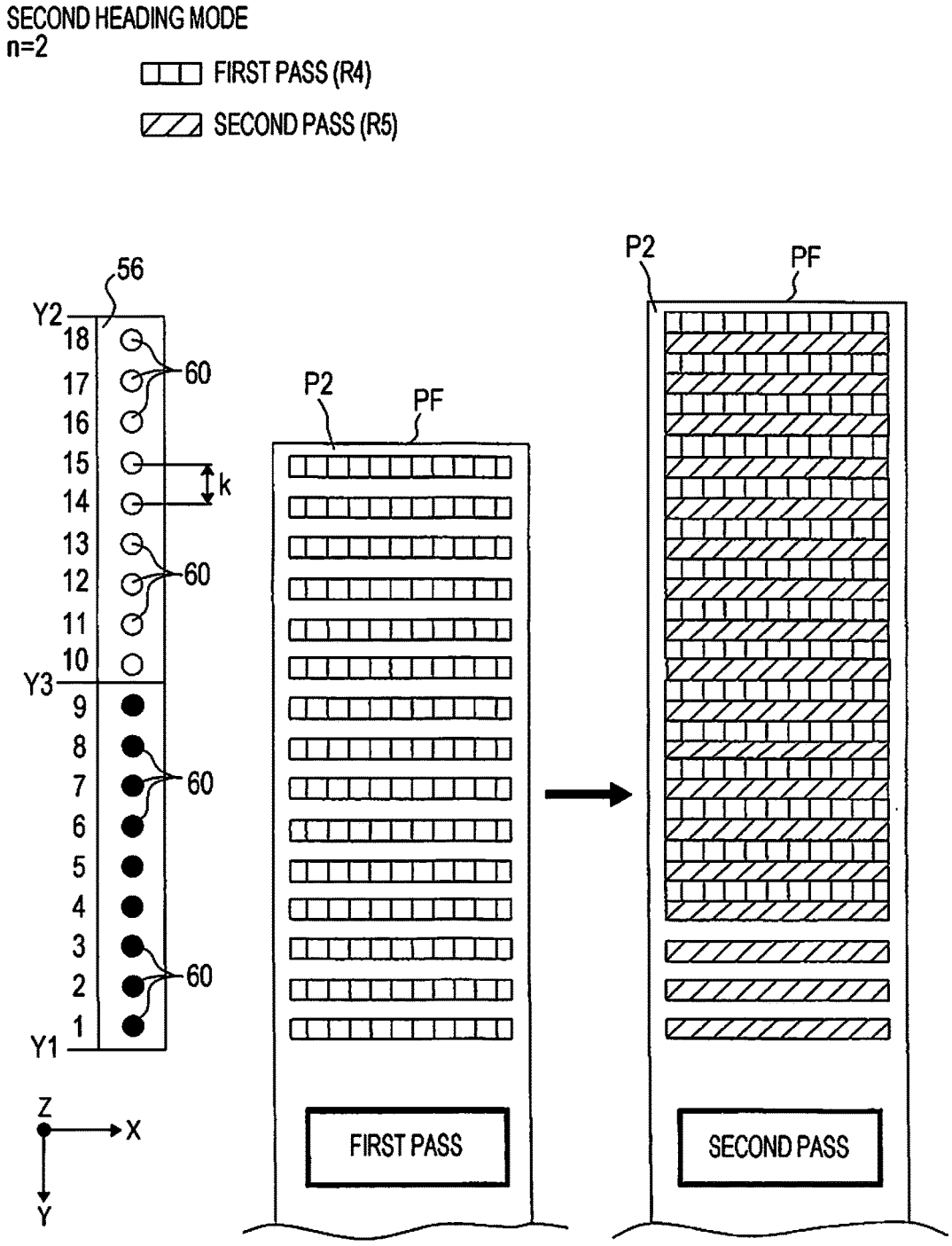
FIG. 9 is a schematic view of the image forming state of a first pass and a second pass of the second heading mode.
Figure 10:
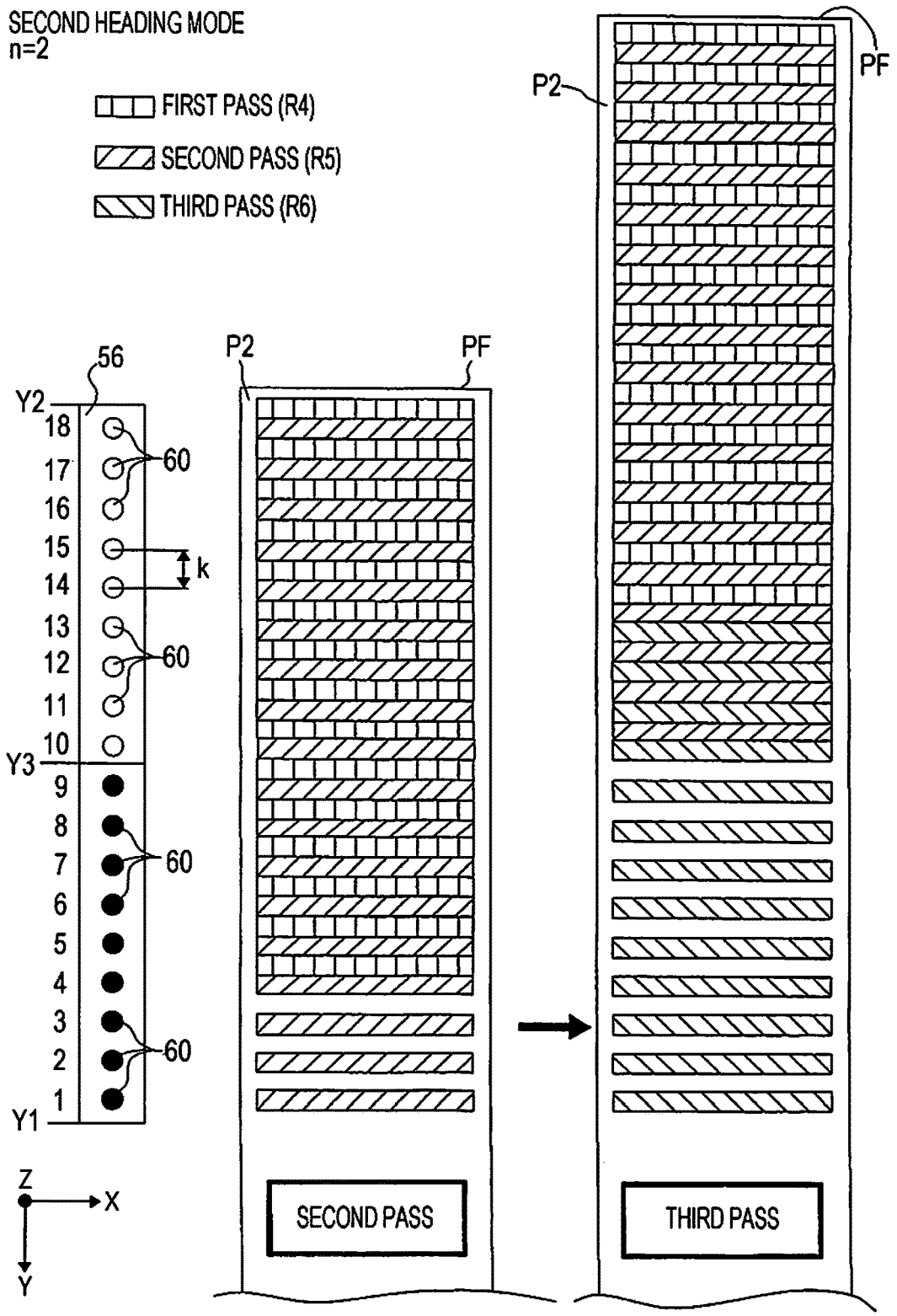
FIG. 10 is a schematic view of an image forming state of a second pass and a third pass of the second heading mode.
Figure 11:
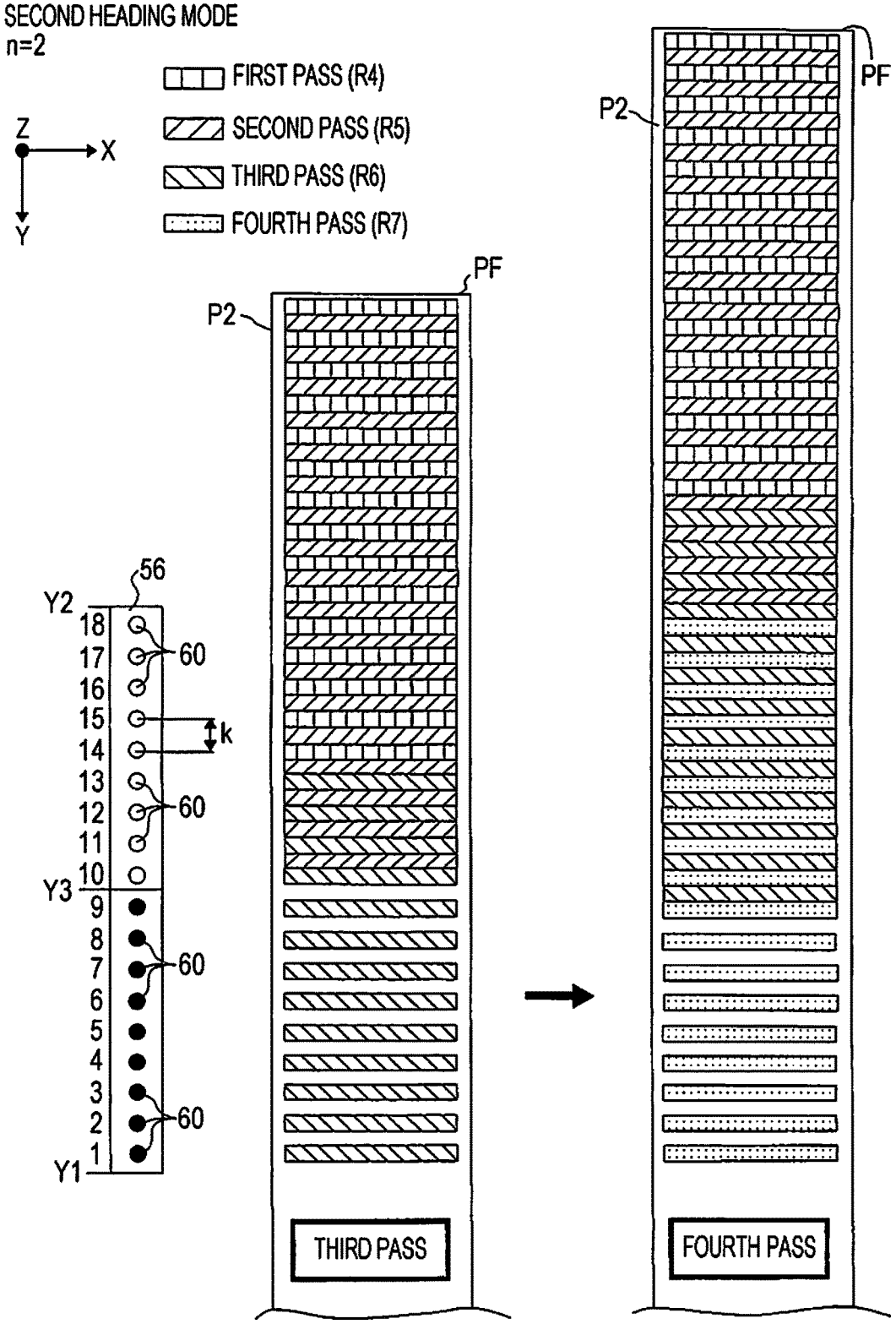
FIG. 11 is a schematic view of an image forming state of the third pass and a fourth pass of the second heading mode.

FIG. 7 is a schematic view of an image forming state of a first pass and a second pass of the first heading mode, FIG. 8 is a schematic view of the image forming state of the second pass and a third pass of the first heading mode, FIG. 9 is a schematic view of the image forming state of a first pass and a second pass of the second heading mode, FIG. 10 is a schematic view of an image forming state of a second pass and a third pass of the second heading mode, FIG. 11 is a schematic view of an image forming state of the third pass and a fourth pass of the second heading mode, and FIG.

12 is a schematic view of an image forming state of a first pass and a second pass of a first heading mode according to a second example.

Figure 13:
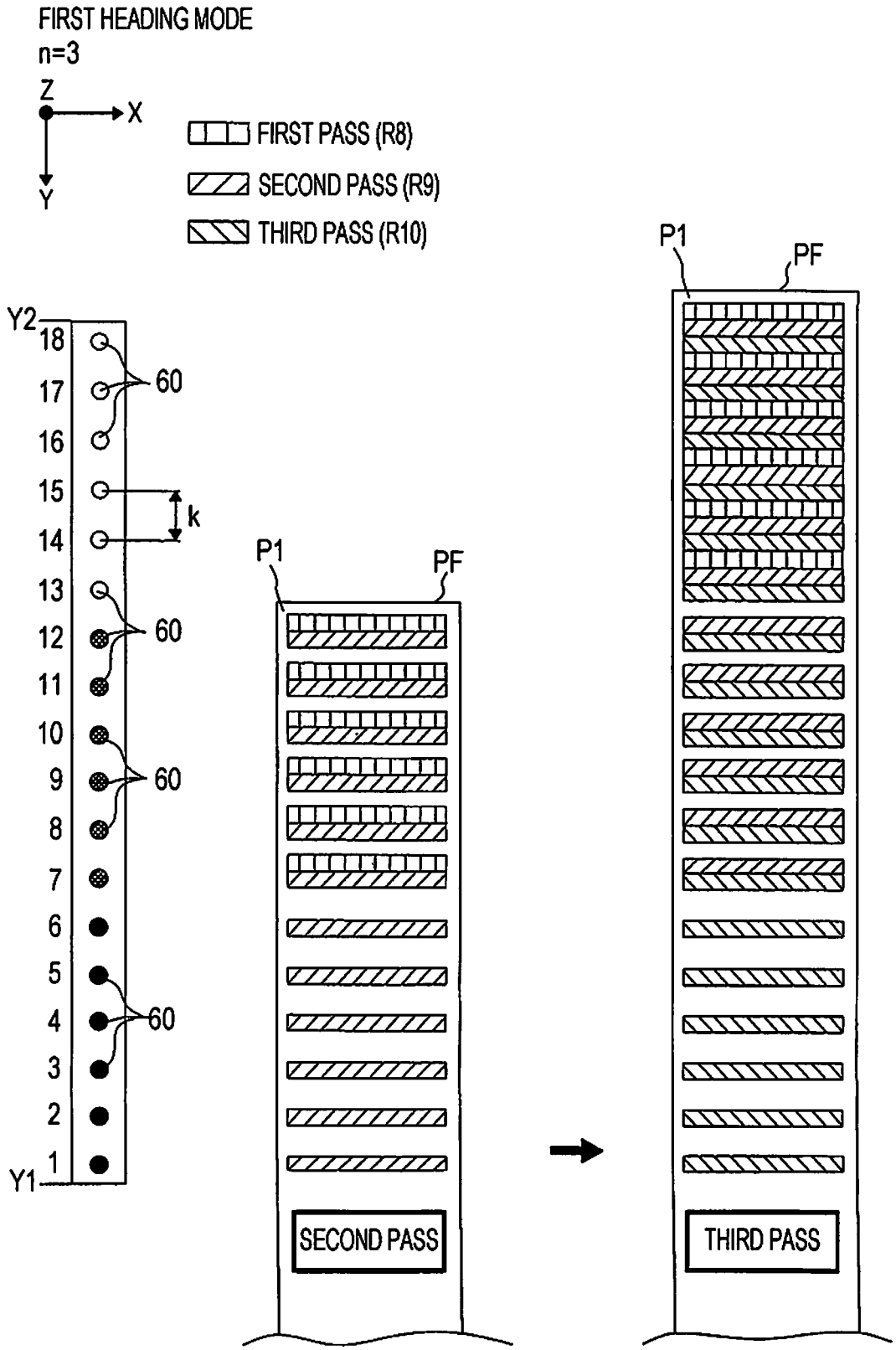
FIG. 13 is a schematic view of the image forming state of the second pass and a third pass of the first heading mode according to the second example.
Figure 14:
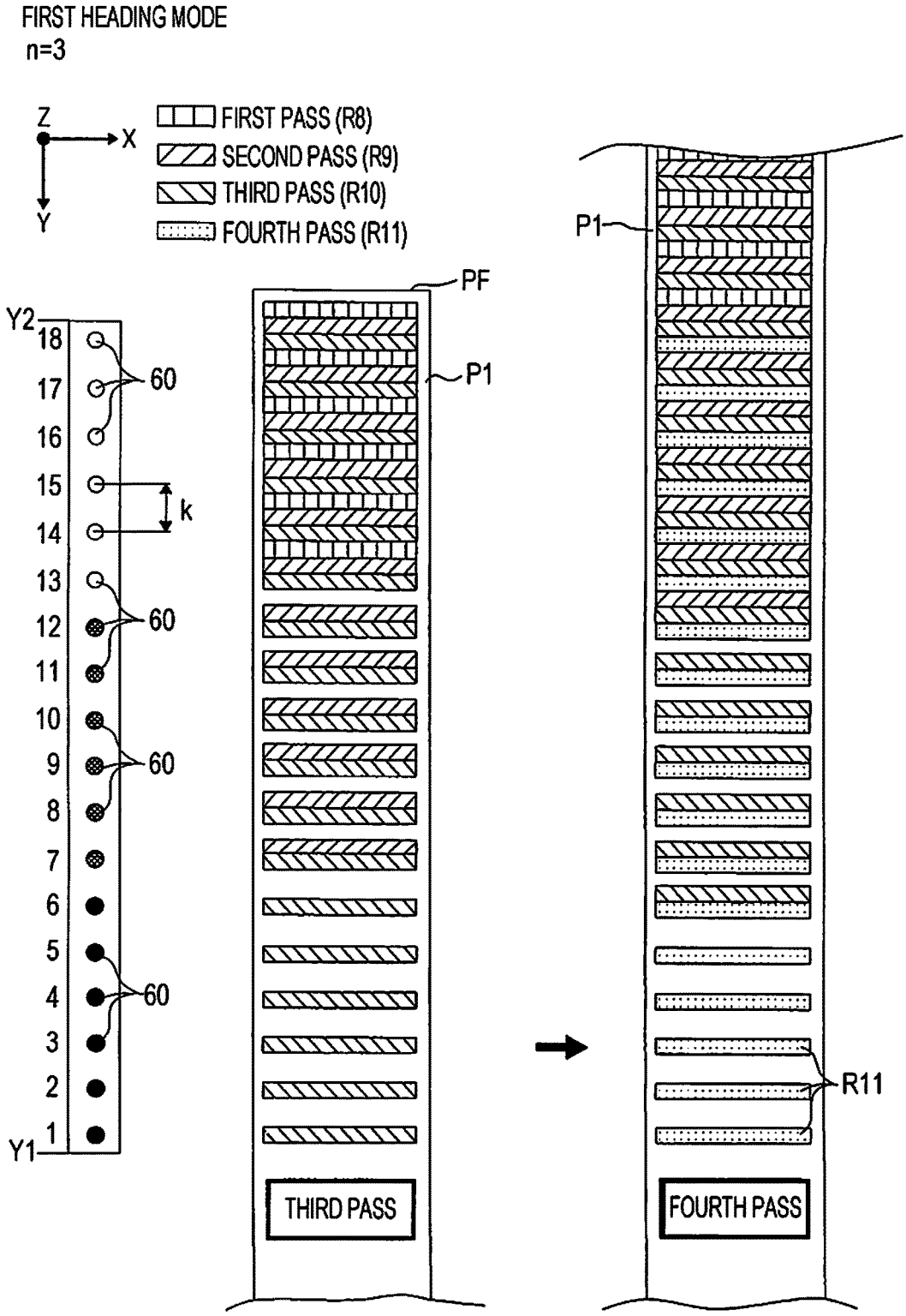
FIG. 14 is a schematic view of the image forming state of the third pass and a fourth pass of the first heading mode according to the second example.
Figure 15:
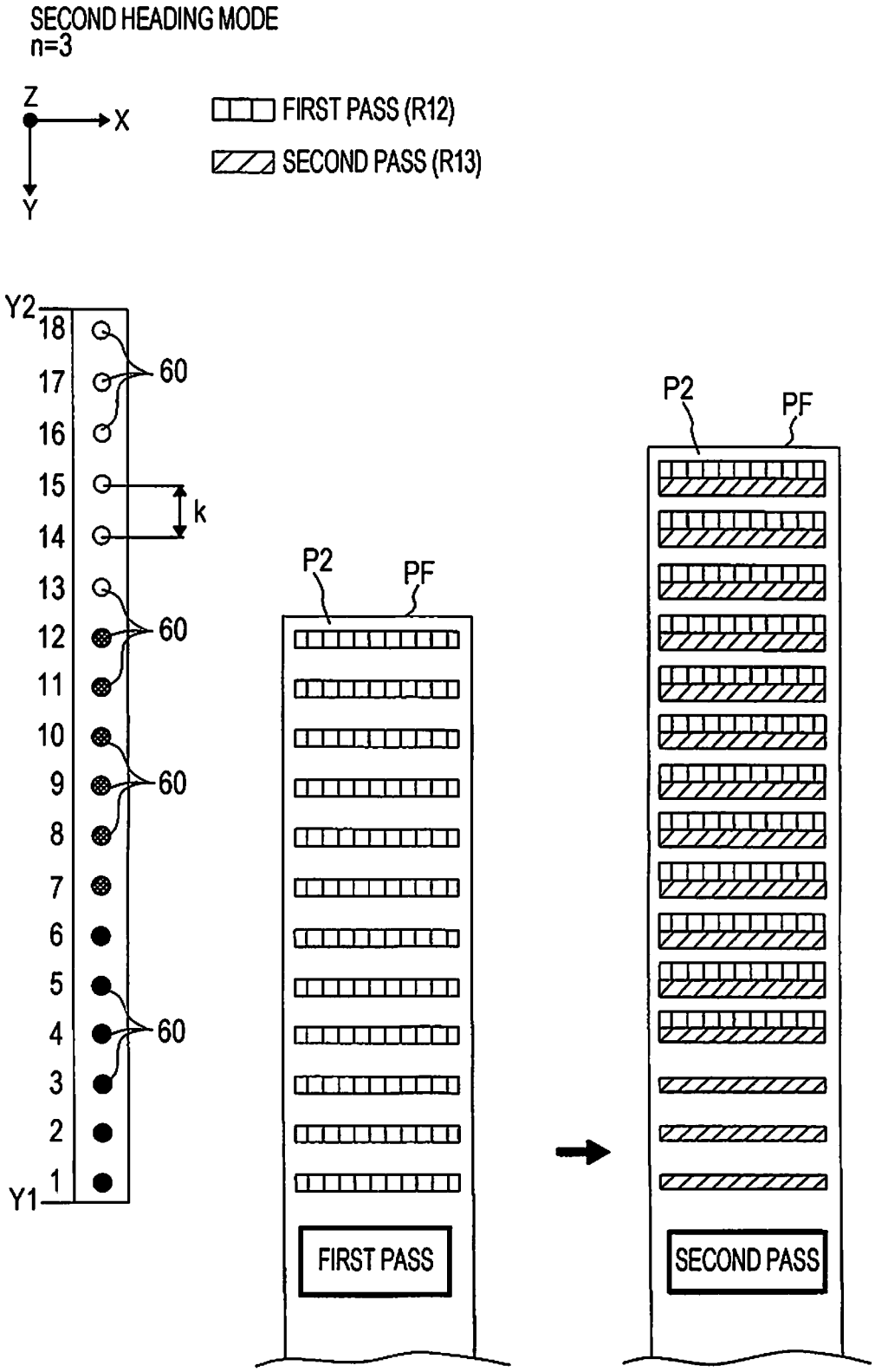
FIG. 15 is a schematic view of an image forming state of a first pass and a second pass of a second heading mode according to the second example.
Figure 16:
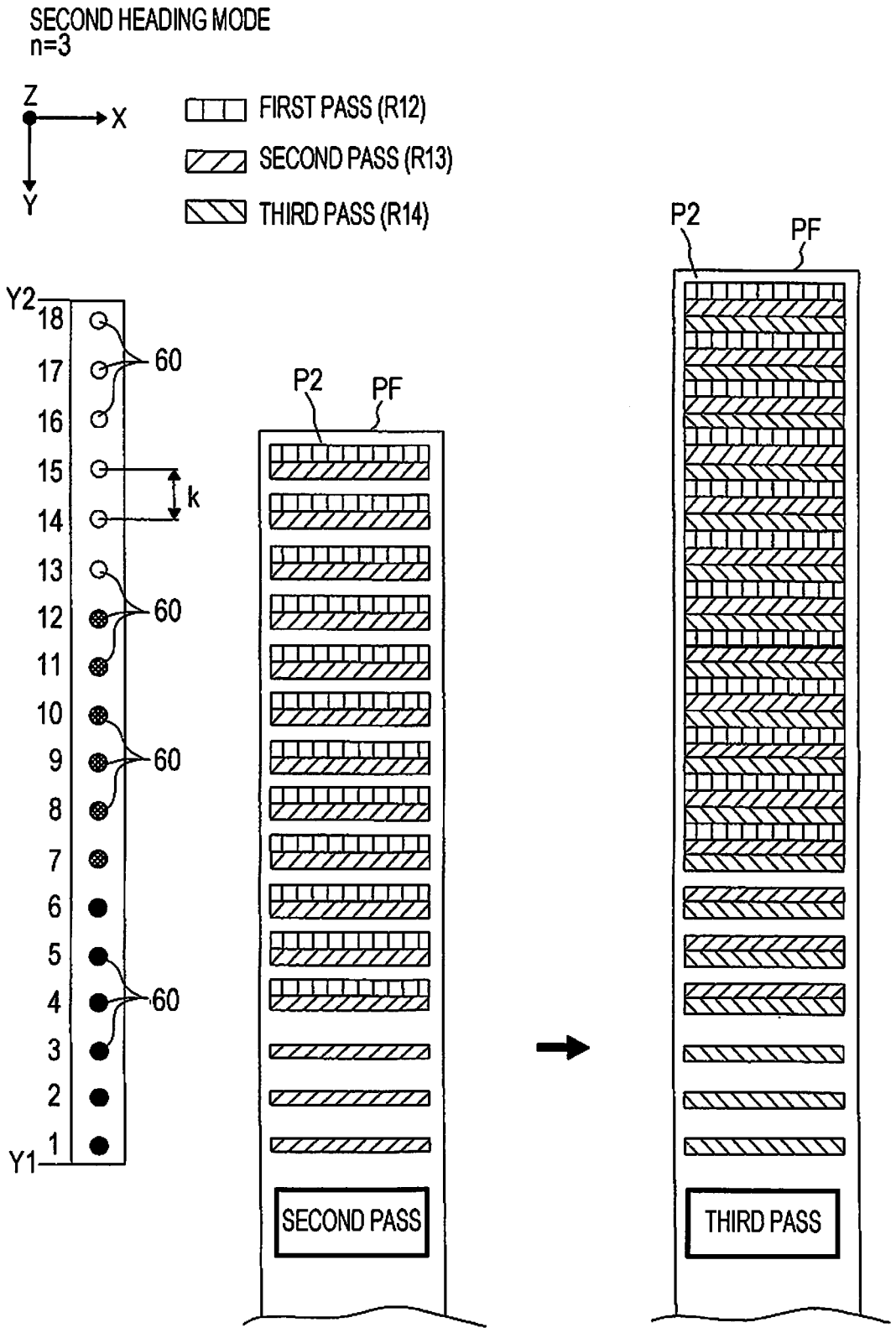
FIG. 16 is a schematic view of the image forming state of the second pass and a third pass of the second heading mode according to the second example.
Figure 17:
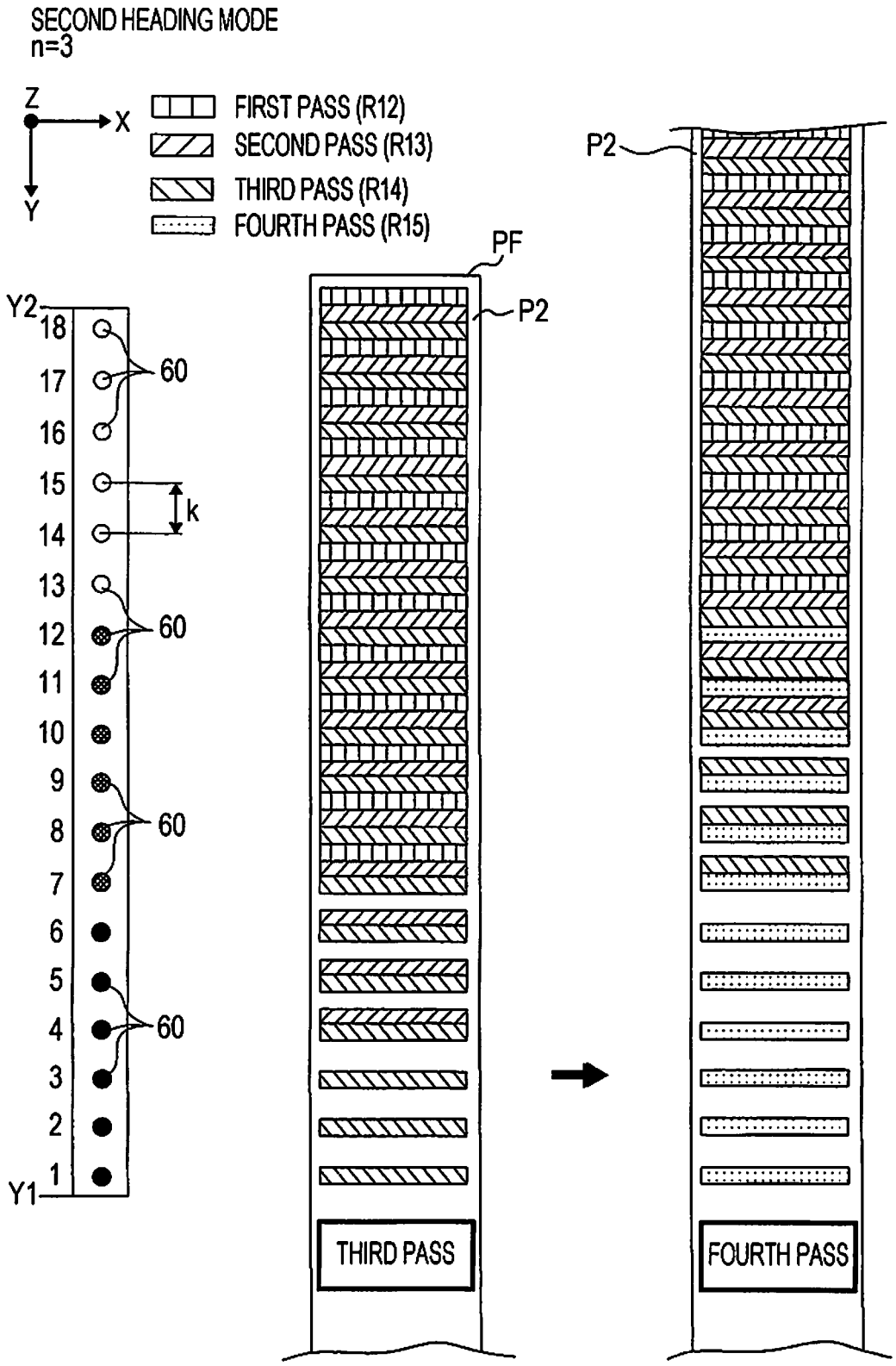
FIG. 17 is a schematic view of the image forming state of the third pass and a fourth pass of the second heading mode according to the second example.
Figure 18:
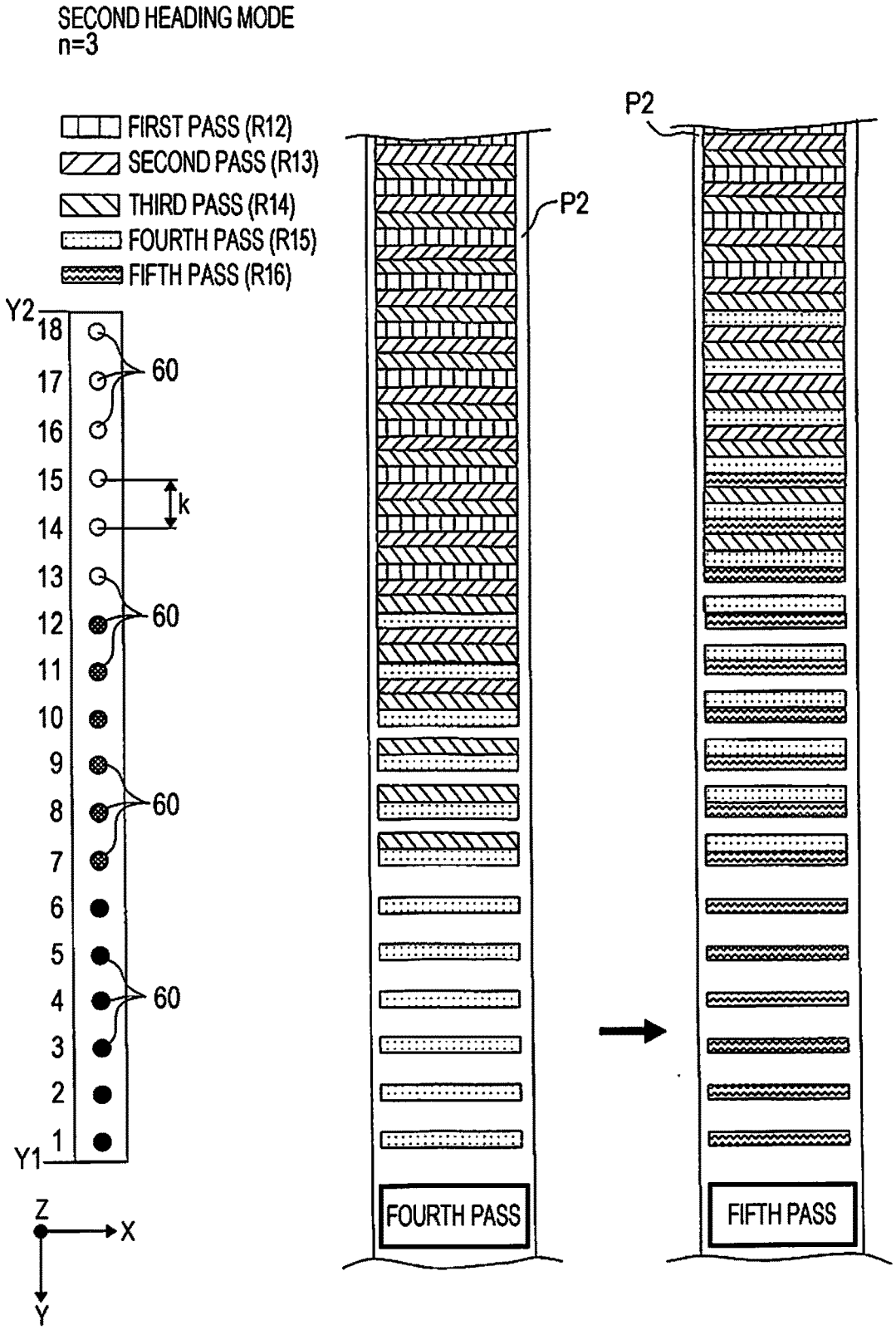
FIG. 18 is a schematic view of the image forming state of the fourth pass and a fifth pass of the second heading mode according to the second example.

FIG. 13 is a schematic view of the image forming state of the second pass and a third pass of the first heading mode according to the second example, FIG. 14 is a schematic view of the image forming state of the third pass and a fourth pass of the first heading mode according to the second example, FIG. 15 is a schematic view of an image forming state of a first pass and a second pass of a second heading mode according to the second example, FIG. 16 is a schematic view of the image forming state of the second pass and a third pass of the second heading mode according to the second example, FIG. 17 is a schematic view of the image forming state of the third pass and a fourth pass of the second heading mode according to the second example, and FIG. 18 is a schematic view of the image forming state of the fourth pass and a fifth pass of the second heading mode according to the second example.

In addition, in an X-Y-Z coordinate system illustrated in each drawing, an X direction indicates a main scanning direction (moving direction) of a carriage, that is, a width direction of the recording apparatus, a Y direction indicates a depth direction of a recording apparatus, and a Z direction indicates a height direction of the apparatus. Also, in each drawing, a +X direction side is set to a left side of the apparatus, a −X direction side is set to a right side of the apparatus, a −Y direction is set to a front surface side of the apparatus, a +Y direction side is set to a rear surface side of the apparatus, a +Z axis direction side is set to an upper side of the apparatus, and a −Z axis direction side is set to a lower side of the apparatus.

First Example

Outline of Printer

With reference to FIG. 1, the printer 10 is provided with an apparatus main body 12 and a scanner portion 14 which is provided on an upper portion of the apparatus main body 12 to be able to be rotated with respect to the apparatus main body 12. An operating portion 16 executing operations of the printer 10 is provided on a front surface side in a depth direction of the apparatus of the apparatus main body 12. On the front surface side in the depth direction of the apparatus of the apparatus main body 12, a discharging tray 18 which receives a medium discharged from the inside of the apparatus main body 12 is provided on the lower side in the height direction of the apparatus of the operating portion 16. The discharging tray 18 protrudes from the front surface side in the depth direction of the apparatus.

A medium accommodating portion 20 which accommodates a medium is provided on the lower side in the height direction of the apparatus of the discharging tray 18 in the apparatus main body 12. As an example, the medium accommodating portion 20 is mounted to be removable from the front surface side in the depth direction of the apparatus with respect to the apparatus main body 12. In addition, a virtual line in FIG. 1 indicates an expansion medium accommodating portion 22. As an example, the expansion medium accommodating portion 22 which is capable of accommodating the medium can be mounted under the medium accommodating portion 20 of the apparatus main body 12 in the printer 10. Also, the medium being accommodated in the expansion medium accommodating portion 22 may be a medium having the same type or the same size as those of a medium being accommodated in the medium accommodating portion 20, and may be a medium having a different type and a different size from those of a medium being accommodated in the medium accommodating portion 20.

The scanner portion 14 is provided on an upper part of the apparatus main body 12. The scanner portion 14 is provided with a scanner main body 24 and an ADF 26. As an example, the scanner main body 24 is configured to be closable with respect to the apparatus main body 12 with the rear surface side in the depth direction of the apparatus as a rotation axis. An original document reading surface 28 is provided on an upper part of the scanner main body 24 as illustrated in FIG. 2. The original document reading surface 28 is formed of a flat glass plate, and an upper surface thereof is capable of mounting the original document. In addition, an original document reading unit for reading the original document mounted on the original document reading surface 28 is provided under the original document reading surface 28 inside the scanner main body 24.

As an example, the ADF 26 is attached to be rotatable with respect to the scanner main body 24. The ADF 26 is provided with an original document mounting tray 26*a* to which the original document is mounted, and an original document discharging tray 26*b* which the original document is discharged after the medium is transported from the original document mounting tray 26*a*, and read using the original document reading surface 28.

In addition, a cover member 30 which is closable with respect to the apparatus main body 12 is provided at an end portion on the rear surface side in the depth direction of the apparatus in the apparatus main body 12. When the cover member 30 is in a state of being opened to the apparatus main body 12 (not illustrated), a medium feeding portion 32 disposed inside the cover member 30 can be accessible. The medium feeding portion 32 will be described later.

Regarding Transportation Path of Medium

Next, with reference to FIG. 2, a transportation path of the medium will be described. A broken line with a reference sign T1 in FIG. 2 indicates a transportation path of a medium accommodated in the medium accommodating portion 20 being transported from the medium accommodating portion 20 to the discharging tray 18. In addition, a broken line with a reference sign T2 indicates a feeding path of a medium being fed from the medium feeding portion 32 to the discharging tray 18.

First, a medium transportation path T1 from the medium accommodating portion 20 to the discharging tray 18 will be described. The medium accommodated in the medium accommodating portion 20 is supported to come into contact with a first feeding roller 34, and is fed toward a pair of rollers 36 positioned on a downstream side in a transporting direction by the first feeding roller 34. The pair of rollers 36 is provided with a second feeding roller 38 and a first separating roller 39 to which a rotational resistance is applied. The medium fed to the pair of rollers 36 is nipped by a second feeding roller 38 and the first separating roller 39, and is fed toward a third feeding roller 42 through a curved path 40 provided on a downstream side in a medium transporting direction. Also, the curved path 40 is formed as a path where the medium is bent and transported, and as an example, the pair of rollers 36 constitutes a transportation load applying portion 44 which applies the medium transportation load.

Driven rollers 46*a* and 46*b* are disposed around the third feeding roller 42 so as to be rotatably driven with respect to the third feeding roller 42. The medium, which is fed to the third feeding roller 42 through the pair of rollers 36 and the curved path 40, that is, the transportation load applying portion 44, is nipped by the third feeding roller 42 and the driven rollers 46*a* and 46*b* in this order, and is transported to a downstream side in the transporting direction. Also, a transporting roller pair 48 is provided on the downstream side in the transporting direction. The transporting roller pair 48 is provided with a transportation driving roller 48*a* and a transportation driven roller 48*b*. Also, a medium detecting sensor 50 which detects a medium is provided between the third feeding roller 42 and the transporting roller pair 48 in the medium transportation path T1. In addition, the third feeding roller 42 and the transporting roller pair 48 constitute a transporting unit 49 which transports a medium to a recording position to be described later which is a position facing a nozzle row of a recording head 56.

A recording portion 52 is provided on the downstream side in the transporting direction of the transporting roller pair 48 in the medium transportation path T1. The recording portion 52 is provided with a carriage 54, a recording head 56 provided on a lower portion of the carriage 54, and a medium supporting member 58 which is provided under the recording head 56 and faces the recording head 56.

The carriage 54 is configured to be able to reciprocate in a width direction of the apparatus (direction intersecting paper surface in FIG. 2) of the printer 10 by a driving unit which is not illustrated. In addition, a plurality of ink discharging nozzles 60 (refer to FIG. 7 or FIG. 18) are provided on a lower surface of the recording head 56 as "liquid discharging nozzles". As an example, the plurality of ink discharging nozzles 60 constitute a plurality of nozzle rows in the lower surface of the recording head 56. The plurality of nozzle rows are arranged with an appropriate interval along the transporting direction of the medium as an example. In addition, the ink discharging nozzle 60 is configured to be capable of discharging ink as "liquid" toward the lower side in the height direction of the apparatus.

Here, if the transporting roller pair 48 transports a medium to a recording position which is a position facing a nozzle row of the recording head 56, ink is discharged from a plurality of the ink discharging nozzles 60, and thus recording is executed on the medium. Also, if the recording on the medium is finished, the medium is nipped by a pair of discharging rollers 62 provided on the downstream side in the transporting direction of the recording portion 52 and is discharged toward the discharging tray 18. Also, the pair of discharging rollers 62 is provided with a discharge driving roller 62*a* and a discharging driven roller 62*b*.

Next, a medium feeding path T2 will be described. A medium supporting tray 64, a fourth feeding roller 66, and a second separating roller 68 to which a rotational resistance is applied, are provided in the medium feeding portion 32. If a medium is set in the medium supporting tray 64, the medium is nipped by the fourth feeding roller 66 and the second separating roller 68, and is fed to the downstream side in a feeding direction. The medium fed on the downstream side in the feeding direction is nipped by the third feeding roller 42 and the driven roller 46*b* and is fed to the recording portion 52. Also, when recording is executed by the recording portion 52, the medium is discharged toward the discharging tray 18 by the pair of discharging rollers 62.

A broken line with a reference sign T3 in FIG. 2 indicates a reverse path where the medium is sent back and reversed from the recording portion 52 to the third feeding roller 42, a broken line with a reference sign T4 indicates a medium transportation path where the medium is fed from the expansion medium accommodating portion 22 to the third feeding roller 42.

Regarding Controller

Next, an example of controlling of a controller 70 provided in the apparatus main body 12 of the printer 10 will be described with reference to FIG. 3.

The controller 70 is electrically connected to an operating portion 16, and is configured to control operation of the printer 10 based on an input signal in the operating portion 16. In addition, the controller 70 controls rotation of a first driving motor 74 through the motor driver 72. Also, the first driving motor 74 rotatably drives the transportation driving roller 48*a* and the discharge driving roller 62*a*. In addition, the controller 70 measures an amount of rotation of the first driving motor 74 based on a detection signal of a rotary encoder 76, and feedback-controls the first driving motor 74 based on the measured result.

In addition, the controller 70 controls rotation of the second driving motor 80 through a motor driver 78. Also, the second driving motor 80 rotatably drives the first feeding roller 34, the second feeding roller 38, the third feeding roller 42, and the fourth feeding roller 66. In addition, an amount of rotation of the second driving motor 80 is measured on the basis of a detection signal of a rotary encoder 82, and the second driving motor 80 is feedback-controlled on the basis of the measured result.

Further, a controller 70 controls a rotation operation of the first driving motor 74 and the second driving motor 80 through the motor drivers 72 and 78 according to the detection signal of the medium in the medium detecting sensor 50, and controls a feeding operation of the medium in the medium transportation path T1 and the medium feeding path T2.

Regarding Execution of Recording Operation in Recording Portion

Next, the first heading mode will be described with respect to FIGS. 7 and 8, and the second heading mode will be described with reference to FIGS. 9 to 11, but first, selection of the first heading mode and the second heading mode will be described with reference to FIGS. 4 to 6.

The controller 70 acquires medium length information from driver information including information relating to a medium being input to the operating portion 16, or driver information received from a printer driver being operated by an external computer which is not illustrated (Step S101). In addition, record starting position information is acquired from the driver information (Step S102). In other words, the record starting position information is information relating to an amount of margin at a front end of the medium.

Next, based on the medium length information and the record starting position information, in a case in which the first heading mode is adopted and the medium is head, it is determined whether or not the rear end of the medium comes out of the first separating roller 39 (Step S103).

Here, the first heading mode is a heading mode which is generally executed by the controller 70, the second heading mode is a heading mode in which an amount of transportation for heading is greater than that of the first heading mode, and these heading modes will be described later.

Also, a heading operation is completed by executing a medium transporting operation of a predetermined amount at a timing when a front end of the medium is detected by the medium detecting sensor 50 (FIG. 2).

The controller heads the medium at the selected heading mode (Steps S104 and S105), and subsequently, until recording is completed (Yes in Step S108), a recording operation as one pass, that is, an operation of discharging ink while moving the carriage 54 (Step S106), and a medium feeding operation (Step S107) are alternately repeated.

Also, the "pass" indicates a recording operation being executed by moving the carriage once. An operation of transporting a medium to a position where recording of one pass in the beginning is executed is a "heading operation".

Here, determination of Step S103 will be described in detail. If a rear end PE of a medium is nipped by the pair of rollers 36, that is, the second feeding roller 38 and the first separating roller 39 (FIG. 2) at the heading operation completed timing as illustrated in FIG. 5, large back tension is generated in a medium P, and thus slipping is generated in the transporting roller pair 48 (FIG. 2), and there is a concern that an appropriate amount of transportation is not obtained.

Here, in Step S103, the controller 70 determines whether or not the rear end PE of the medium comes out of the first separating roller 39 at the heading operation completed timing, if the rear end of the medium is determined not to come out, the second heading mode is selected in which the amount of transportation for heading is much more. Accordingly, the rear end PE of the medium can be expected to come out of the first separating roller 39 at the time of starting recording, otherwise, recording operation time in a state in which the rear end of the medium is in contact with the first separating roller 39 can be reduced, even when the rear end of the medium does not come out. As a result, in a state in which influence of the back tension is avoided or reduced, the better recording result can be obtained. In addition, in Step S103, as illustrated in FIG. 6, in a case in which the rear end PE of the medium is determined to come out of the first separating roller 39 at the heading operation completed timing, the first heading mode is selected.

Regarding Recording Operation in Case of Selecting First Heading Mode

A recording operation in a case in which the first heading mode is selected will be described with reference to FIGS. 7 and 8. Here, a position Y1 in FIGS. 5 to 8 indicates a position of a nozzle, which is provided on the most upstream side in a transporting direction, in a plurality of nozzles provided on a lower surface of the recording head 56, a position Y2 indicates a position of a nozzle, which is provided on the most downstream side in the transporting direction, in the plurality of nozzles, and a range from the position Y1 to the position Y2 in the transporting direction is a range where the nozzle is provided in the recording head 56. In addition, a position Y3 indicates an intermediate position between the position Y1 and the position Y2.

In addition, in FIGS. 7 to 11, the transporting direction of the medium is a direction from a lower side toward an upper side of a paper surface, a change of the number of a recording operation (pass) in the medium is illustrated from a left side of the paper surface toward a right side of the paper surface, and a schematic view of the position of the nozzle of the recording head 56 corresponding to the paper surface of the medium on the left side of each drawing is illustrated.

In the schematic views of the recording head 56 illustrated in FIGS. 7 and 8, 18 ink discharging nozzles 60 in the medium transporting direction are illustrated as an example. Also, in each drawing, a corresponding nozzle number is given to a left side of a circle indicating each ink discharging nozzle 60. However, as an example, the number of nozzles constituting a nozzle row is set to 18, but the number of nozzles constituting the nozzle row is not limited to 18, and can be appropriately changed.

In addition, it is not illustrated in the drawings, but the plurality of ink discharging nozzles 60 are provided with an interval along a direction intersecting the medium transporting direction, that is, a moving direction of the carriage 54. Also, in order to describe, the ink discharging nozzle 60 illustrated in FIGS. 7 to 11 will be described as an example of the nozzle row.

Recording of particularly a first pass in the beginning among the recording operations by the recording head 56, as an example, is an operation in which a medium is transported (heading is executed) so as to face a nozzle row of a part of an upstream side among the plurality of nozzles provided along the medium transporting direction, the carriage 54 is moved in a moving direction (scanning direction), and ink from the ink discharging nozzle 60 facing the medium is discharged to the medium.

In a state in which one pass is finished, there is a region where the recording is not executed between the raster lines, and thus the region where the recording is not executed is filled by subsequent passes so that contents of the recording are completed. Also, the "raster line" indicates a dot row formed by one nozzle row in one pass.

As described above, the recording operation in the example is a recording mode in which the contents of the recording are completed by executing recording as one pass many times (n times). In the example, the recording mode in which the contents of the recording of are completed by two passes, that is, n=2 is illustrated, but it is not limited thereto, and n may be equal to or more than 3.

Also, the number of nozzles facing a medium P1 by the heading operation is set to the number obtained by dividing a total number of nozzles by n. In the example, the nozzle row is constituted by 18 nozzles, n is equal to 2, and thus heading is executed so that a nozzle No. 1 to a nozzle No. 9 face the medium.

To further describe, in the first heading mode according to the example, as illustrated in FIG. 6, the controller 70 feeds a front end PF of the medium P1 to the intermediate position Y3 in a plurality of the ink discharging nozzles 60 (nozzle row) which are arranged in the medium transporting direction in the recording head 56. Accordingly, as illustrated in FIG. 7, the medium P1 faces nozzles of the nozzle No. 1 to the nozzle No. 9.

Also, recording of one pass in the beginning is executed as illustrated in FIG. 7. That is, ink is discharged to the medium P1 using the nozzles of the nozzle No. 1 to the nozzle No. 9 facing the medium P1. Accordingly, the recording operation as the one pass in the beginning is executed. In FIG. 7, the recorded part in which ink is discharged from the nozzles of the nozzle No. 1 to the nozzle No. 9 facing toward the medium P1, that is, the recorded part as the one pass in the beginning is set to R1. As illustrated in drawings, nine raster lines are formed on the medium P1 due to the recording of the first pass.

Next, the controller 70 executes the transporting operation of the medium P1 so that gaps between the raster lines formed in the beginning is filled with raster lines formed by subsequent passes. Specifically, in the example, the medium P1 is transported so that a nozzle No. 18 is positioned between the forefront raster line and the second raster line. The amount of transportation at this time can be represented by $[(9+1/n)\times k]$. Here, k is a nozzle pitch (FIG. 7), and n is 2 in the example.

The controller 70 discharges ink from the nozzles of from the nozzle No. 1 to the nozzle No. 18. Accordingly, the gaps between the raster lines formed by the first pass are filled, and the contents of the recording of the part are completed.

Then, the medium P1 is transported so that the gaps between the raster lines formed by the previous pass in the same manner are filled with raster lines to be formed by subsequent passes, and ink is discharged using all nozzles of the nozzle No. 1 to the nozzle No. 18.

As a reference, FIG. 8 illustrates a shape of a dot formation of the second pass and the third pass. The amount of the medium P1 transported at the time of executing the second pass and the third pass can be represented by [(8+1/n)×k]. That is, the amount of the medium transported in a case of n=2 slightly varies for each pass.

Also, the reference sign R1 in FIGS. 7 and 8 indicates the raster line formed by the first pass, the reference sign R2 indicates the raster line formed by the second pass, and the reference sign R3 indicates the raster line formed by the third pass.

Hitherto, the example of the recording operation after the first heading mode is adopted is described. Recording Operation in Case of Selecting Second Heading Mode Next, the recording operation in the second heading mode will be described with reference to FIGS. 9 to 11. The second heading mode is a mode in which the amount of transportation for heading is set to be greater than that of the first heading mode. Also, the second heading mode is also described on the premise that a recording mode in which n is also equal to 2 in the second heading mode, that is, the contents of the recording are completed by operations of two passes.

The number of nozzles facing the medium P2 by the heading operation of the second heading mode is greater than the number obtained by dividing a total number of nozzles by n. In the example, the nozzle row is constituted by 18 nozzles, n is equal to 2, and thus heading is executed so that the medium faces at least the nozzle No. 1 to a nozzle No. 10. As an example, in FIG. 9, heading is executed so that the medium faces the nozzle No. 1 to a nozzle No. 15.

Also, the recording of the one pass in the beginning is executed as illustrated in FIG. 9. That is, ink is discharged toward the medium P2 using the nozzles of the nozzle No. 1 to a nozzle No. 15 facing the medium P2. Accordingly, the recording operation as the one pass in the beginning is executed. As illustrated in drawings, 15 raster lines are formed on the medium P2 by the recording of the first pass.

Next, the controller 70 executes the transporting operation of the medium P2 so that the gaps between the raster lines formed in the beginning are filled with the raster line formed by subsequent passes. Specifically, in the example, the medium P2 is transported so that the nozzle No. 18 is positioned between the forefront raster line and the second raster line. The amount of transportation at this time can be represented by [(3+1/n)×k].

Also, the controller 70 causes the nozzles from the nozzle No. 1 to the nozzle No. 18 to discharge ink. Accordingly, the gaps between the raster lines formed by the first pass are filled, and the contents of the recording of the part are completed.

Next, the controller 70 executes the transporting operation of the medium P2, such that a part, where the gaps between the raster lines formed by the second pass are not filled with the raster lines of the one pass in the beginning, is filled with a raster line being formed by a subsequent pass. Specifically, the medium P2 is transported so that a nozzle No. 13 is positioned on a gap between the raster line formed by the nozzle No. 4 and the raster line formed by the nozzle No. 3. The amount of transportation at this time can be represented by [(9+1/n)×k].

The controller 70 executes recording of the third pass by discharging ink from the nozzles of the nozzle No. 1 to the nozzle No. 13. Accordingly, the gaps between the raster lines formed by the second pass are filled, and the contents of the recording of the part are completed.

Also, in a subsequent recording operation of the fourth pass, the medium P2 is transported so that the gaps between the raster lines formed by a previous pass in the same as the recording operation of the first heading mode are filled with the raster line formed by a subsequent pass, and the ink is discharged using all nozzles of the nozzle No. 1 to the nozzle No. 18. Also, in the recording operation of the fourth pass, the medium P2 is transported so that the nozzle No. 18 is positioned on the gap between a raster line formed by a nozzle No. 9 and a raster line formed by the nozzle No. 10. The amount of transportation at this time can be represented by ((8+1/n)×k).

Therefore, an amount of the medium P2 fed by the transporting unit 49 in the second heading mode after the recording operation as the one pass in the beginning is executed can be set to be close to an amount of the medium fed by the transporting unit 49 after the first heading mode is executed.

Also, a reference sign R4 in FIGS. 9 to 11 indicates the raster line formed in the first pass, a reference sign R5 indicates the raster line formed in the second pass, a reference sign R6 indicates the raster line formed in the third pass, and a reference sign R7 indicates the raster line formed in the fourth pass. n is equal to 2 in this example, but it is not limited thereto, and n may be equal to or more than 3.

Hitherto, the recording operation after the second heading mode is adopted is described as an example.

In the above description, there is assumption that rear ends PE of the mediums P1 and P2 come out of the first separating roller 39 in the first heading mode and the second heading mode, but an executing condition in the first heading mode and the second heading mode is not limited thereto, and may be a state in which rear ends PE of the mediums P1 and P2 come out of the curved path 40, as an example, a state in which the rear ends PE of the mediums are positioned on the downstream side in the transporting direction rather than a top portion of a height direction of the apparatus of the third feeding roller in the medium transportation path. Accordingly, the recording operation in a state, in which the back tension is applied to the mediums P1 and P2 due to bending of the mediums P1 and P2, can be further reduced. Therefore, the rear ends PE of the mediums P1 and P2 not being caught by the transportation load applying portion 44 may be set as a condition.

Second Example

Regarding Recording Operation in Case of Selecting First Heading Mode

A second example of the first heading mode will be described with reference to FIGS. 12 to 14. The second example is different from the first example in that the number n of passes, at which the contents of the recording in the medium are completed, is set to 3. First, the first heading mode in which n is equal to 3 will be described with reference to FIGS. 12 to 14. Also, even in this example, the nozzle row is constituted by 18 nozzles.

Since n is equal to 3 in the second example, the heading is executed so that the nozzle No. 1 to the nozzle No. 6 face the medium. Also, as illustrated in FIG. 12, recording of the one pass in the beginning is executed. That is, ink is discharged toward the medium P1 using the nozzles from the first nozzle to the sixth nozzle facing the medium P1. Accordingly, the recording operation as the one pass in the beginning is executed. As illustrated in the drawings, six raster lines are formed on the medium P1 due to the recording of the first pass.

Next, the controller 70 causes the medium P1 to be transported so that the nozzle No. 12 is positioned between the raster line formed by the nozzle No. 6 and the raster line formed by the nozzle No. 5. The amount of transportation at this time can be represented by [(6+1/n)×k]. Also, the controller 70 causes the nozzles of the nozzle No. 1 to the nozzle No. 12 to discharge ink as the second pass. Accordingly, the raster lines corresponding to the nozzle No. 12 from the nozzle No. 1 is formed by the second pass.

Next, the controller 70 causes the medium P1 to be transported so that the nozzle No. 18 is positioned between the raster line formed by the second pass at the position corresponding to the nozzle No. 12 and the raster line formed by the first pass at the position corresponding to a nozzle No. 11 as illustrated in FIG. 13. The amount of transportation at this time can be represented by [(6+1/n)×k].

Also, the controller 70 causes all nozzles of the nozzle No. 1 to the nozzle No. 18 to discharge ink. Accordingly, the raster lines corresponding to the nozzle No. 1 to the nozzle No. 18 are formed by the third pass. Accordingly, the contents of the recording of parts corresponding to the nozzle No. 18 to the nozzle No. 13 are completed using the raster lines formed by the first pass to the third pass.

Next, the controller 70 causes the medium P1 to be transported so that the nozzle No. 18 is positioned at a part where the raster line is not formed between the nozzle No. 13 and the nozzle No. 12 as illustrated in FIG. 14. The amount of transportation at this time can be represented by [(5+1/n)×k].

The controller 70 causes all nozzles of the nozzle No. 1 to the nozzle No. 18 to discharge ink. Accordingly, the raster lines corresponding to the nozzle No. 1 to the nozzle No. 18 are formed by the fourth pass. Also, the contents of the recording of a part corresponding to the nozzle No. 18 to the nozzle No. 13 using the raster line formed by the second pass to the fourth pass are completed.

Then, in the same manner, the medium P1 is transported so that the gaps between the nozzles are filled with the raster lines formed as three passes, and ink is discharged using all nozzles from the nozzle No. 1 to the nozzle No. 18.

In addition, the amount of the medium P1 transported at the time of executing the first pass and the second pass, and the second pass and the third pass is [(6+1/n)×k], and the amount of the medium P1 transported at the time of executing the third pass and the fourth pass is [(5+1/n)×k]. Therefore, the amount of the medium transported in a case in which n is equal to 3 slightly varies for every three passes.

Figure 12:
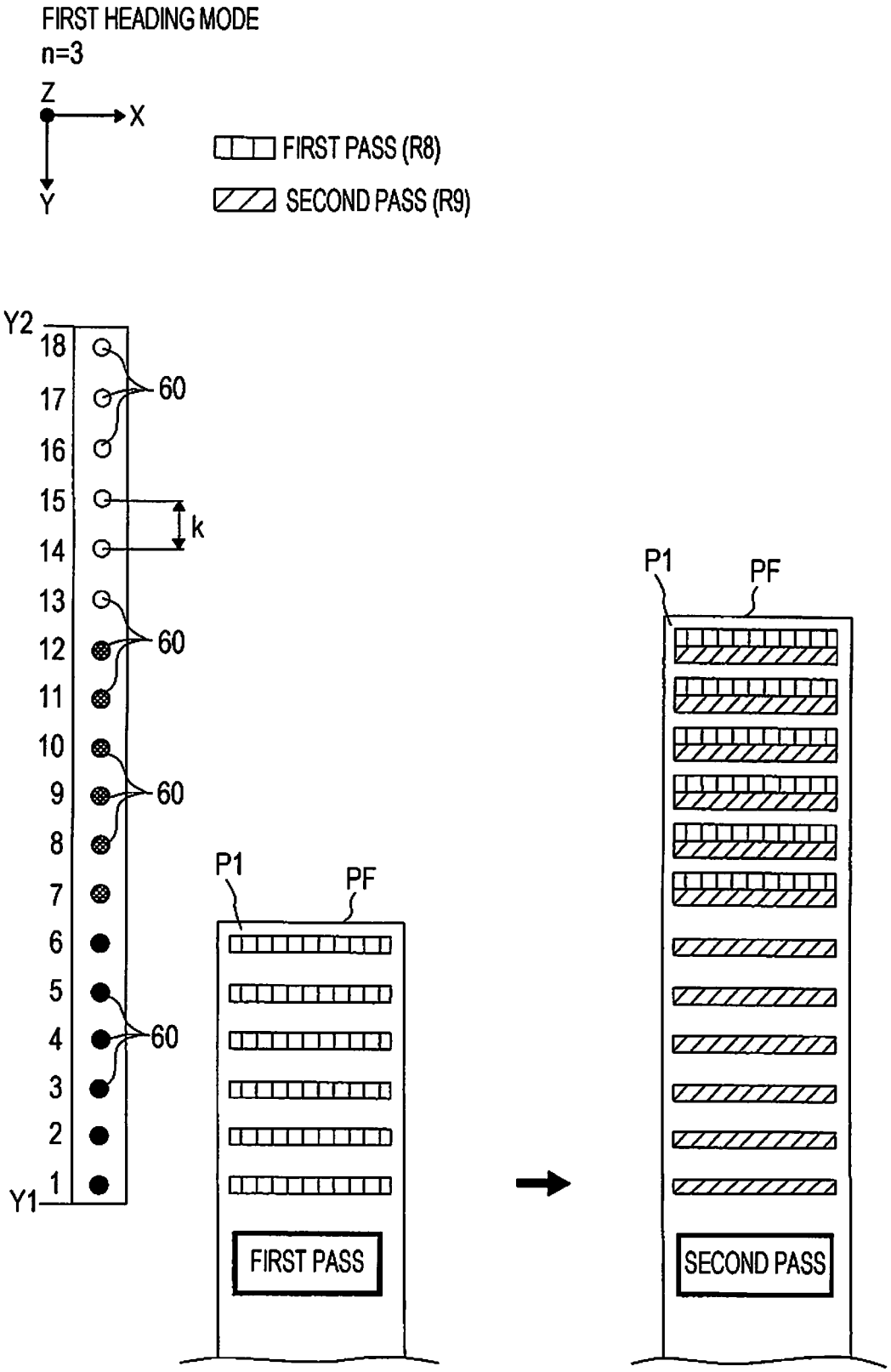
FIG. 12 is a schematic view of an image forming state of a first pass and a second pass of a first heading mode according to a second example.

A reference sign R8 in FIGS. 12 to 14 indicates the raster line formed by the first pass, a reference sign R9 indicates the raster line formed by the second pass, a reference sign R10 indicates the raster line formed by the third pass, and a reference sign R11 indicates the raster line formed by the fourth pass.

Hitherto, the second example of the first heading mode is described.

Regarding Recording Operation in Case of Selecting Second Heading Mode

Next, with reference to FIGS. 15 to 18, a second example of the second heading mode will be described. Also, n in the second heading mode of this example is set to be equal to 3 as same as the first heading mode. As an example, the medium P2 as the one pass in the beginning in the second heading mode faces the nozzles from the nozzle No. 1 to the nozzle No. 12 as illustrated in FIG. 15. The controller 70 causes the nozzles of the nozzle No. 1 to the nozzle No. 12 to discharge ink toward the medium P2, and executes the recording operation as the one pass in the beginning. As illustrated in the drawings, 12 raster lines are formed on the medium P2 by the recording of the first pass.

Next, the controller 70 executes the transporting operation of the medium P2 so that the gaps between the raster lines which are formed in the beginning are filled with the raster lines formed by subsequent passes. Specifically, in the example, the medium P2 is transported so that the nozzle No. 15 is positioned between the raster line formed by the nozzle No. 12 and the raster line formed by the nozzle No. 11. The amount of transportation at this time can be represented by [(3+1/n)×k]. Also, the controller 70 causes the nozzles of the nozzle No. 1 to the nozzle No. 15 to discharge ink as the second pass. Accordingly, the raster lines corresponding to the nozzle No. 1 to the nozzle No. 15 are formed by the second pass.

Next, the controller 70 causes the medium P2 to be transported so that the nozzle No. 18 is positioned between the raster line formed by the second pass at the position corresponding to the nozzle No. 15 and the raster line formed by the first pass at the position corresponding to the nozzle No. 14 as illustrated in FIG. 16. The amount of transportation at this time can be represented by [(3+1/n)×k].

The controller 70 causes all nozzles of the nozzle No. 1 to the nozzle No. 18 to discharge ink. Accordingly, the raster lines corresponding to the nozzle No. 1 to the nozzle No. 18 are formed by the third pass. Accordingly, the contents of the recording of parts corresponding to the nozzle No. 18 to the nozzle No. 7 are completed using the raster lines formed by the first pass to the third pass.

Next, the controller 70 causes the medium P2 to be transported so that the nozzle No. 12 is positioned at a part where the raster line is not formed between the nozzle No. 7 and the nozzle No. 6 as illustrated in FIG. 17. The amount of transportation at this time can be represented by [(5+1/n)×k].

The controller 70 causes the nozzles of the nozzle No. 1 to the nozzle No. 12 to discharge ink. Accordingly, the raster lines corresponding to the nozzle No. 1 to the nozzle No. 12 are formed by the fourth pass. Also, the contents of the recording of parts corresponding to the nozzle No. 12 from the nozzle No. 10 are completed using the raster line formed by the second pass to the fourth pass.

Next, the controller 70 causes the medium P2 to be transported so that the nozzle No. 15 is positioned at a part where the raster line is not formed between the nozzle No. 10 and the nozzle No. 9 as illustrated in FIG. 18. The amount of transportation at this time can be represented by [(5+1/n)×k].

Also, the controller 70 causes the nozzles of the nozzle No. 1 to the nozzle No. 15 to discharge ink. Accordingly, the raster lines corresponding to the nozzle No. 1 to the nozzle No. 15 are formed by the fourth pass. The contents of the recording of parts corresponding to the nozzle No. 15 to the nozzle No. 13 are completed using the raster lines formed by the second pass to the fourth pass.

Then, the medium P2 is transported so that the gaps between the nozzles are filled with the raster lines formed as three passes as same as the first heading mode, and ink is discharged using all nozzles of the nozzle No. 1 to the nozzle No. 18. Also, the amount of the medium P2 transported after the fifth pass is the same as that of the first heading mode.

In addition, the amount of the medium P2 transported at the time of proceeding the first pass and the second pass, and the second pass and the third pass is [(3+1/n)×k], and the amount of the medium P2 transported at the time of executing the third pass and the fourth pass, and the fourth pass and the fifth pass is [(5+1/n)×k]. Also, the amount of the medium P2 transported after the fifth pass slightly varies for every three passes in the same as the first heading mode.

Also, a reference sign R12 in FIGS. 15 to 18 indicates the raster line formed by the first pass, a reference sign R13 indicates the raster line formed by the second pass, a reference sign R14 indicates the raster line formed by the third pass, a reference sign R15 indicates the raster line formed by the fourth pass, and a reference sign R16 indicates the raster line formed by the fifth pass.

Hitherto, the second example of the second heading mode is described as an example.

Modification Example of Each Example

In each example described above, the transportation load applying portion 44 is constituted by the pair of rollers 36, but it is not limited thereto, the curved path 40 may be included, and a configuration in which load is applied to the medium at the time of transporting the medium in the medium transportation path may be included. Also, as a selecting condition of the first heading mode and the second heading mode, a condition of which the rear end PE of the medium comes out of the curved path 40 may be set as a condition, or a configuration in which the rear end comes out of a part where transportation load is applied to the medium in the medium transportation path may be set as a condition.

To summarize the above description, the printer 10 includes the recording head 56 which includes a nozzle row which is provided with the plurality of ink discharging nozzles 60 discharging ink to the mediums P1 and P2 are provided along the medium transporting direction, and executes recording as one pass by discharging ink from the ink discharging nozzles 60 in accordance with movement in a scanning direction intersecting the medium transporting direction, that is, a moving direction of the carriage 54, the transporting unit 49 which transports the medium to a recording position which is a position facing the nozzle row, and the controller 70 which is capable of acquiring information relating to lengths of the mediums P1 and P2 in the medium transporting direction and controls the recording head 56 and the transporting unit 49, in which the controller 70 determines the ink discharging nozzle 60 being used for the recording operation as the one pass in the beginning in accordance with the lengths of the mediums P1 and P2 in the medium transporting direction, and executes the heading operation for feeding the mediums P1 and P2 to the position facing the determined ink discharging nozzle 60.

According to the configuration described above, since the controller 70 determines the ink discharging nozzle 60 used for the recording operation as the one pass in the beginning in accordance with the lengths of the mediums P1 and P2 in the medium transporting direction, and executes the heading operation for feeding the mediums P1 and P2 to the position facing the determined ink discharging nozzle 60, in a case in which the rear ends PE of the mediums P1 and P2 are positioned on a region where the back tension is generated, the ink can be discharged from the ink discharging nozzle 60 in a state in which influence of the back tension is avoided or reduced by executing heading in order to feed the mediums P1 and P2 to further downstream side. As a result, the better recording result can be obtained.

The printer 10 includes the transportation load applying portion 44 which applies the transportation load to the mediums P1 and P2 in the medium transportation path on further upstream side than the transporting unit 49, the controller 70 is capable of selecting the first heading mode, and the second heading mode in which the number of the ink discharging nozzles 60 to face the medium P2 in the first heading mode increases, as the heading operation, and the second heading mode is a heading mode in which the rear end PE of the medium P2 is transmitted through the transportation load applying portion 44 in a case in which the rear end PE of the medium P2 is determined to be caught by the transportation load applying portion 44 if the first heading mode is selected.

According to the configuration described above, the first heading mode and the second heading mode are provided, and the second heading mode is a heading mode in which the rear end PE of the medium P2 is transmitted through the transportation load applying portion 44 in a case in which the rear end PE of the medium P2 is determined to be caught by the transportation load applying portion 44 if the first heading mode is selected, and thus the ink can be discharged from the ink discharging nozzle 60 in a state in which influence of the back tension is avoided or reduced, by selecting the second heading mode. As a result, the better recording result can be obtained.

The recording operation as the one pass in the beginning is a recording operation as the one pass in the beginning of the recording mode, in which recording as one pass by the recording head 56 and feeding of the medium by the transporting unit 49 are alternately executed, and the contents of the recording are completed by executing recording as one pass n times.

The first heading mode is a mode in which the medium P1 faces the ink discharging nozzles 60 as the number obtained by dividing the number of the ink discharging nozzles 60 of the nozzle row in the medium transporting direction by n, and the second heading mode is a mode in which the medium P2 faces the ink discharging nozzles 60 more than the number obtained by dividing the number of the ink discharging nozzles 60 of the nozzle row in the medium transporting direction by n.

The controller 70 executes the second heading mode, and an amount of the medium fed by the transporting unit 49 after recording as the one pass in the beginning is executed is close to an amount of the medium fed by the transporting unit 49 after the first heading mode is executed.

The transportation load applying portion 44 is configured with the pair of rollers 36 constituted by the second feeding roller 38 which feeds a medium, and the first separating roller 39 which nips the mediums P1 and P2 between the second feeding roller 38 and the second feeding roller and receives a rotational resistance.

The transportation load applying portion 44 is configured with the curved path 40 through which the mediums P1 and P2 are bent and transported.

In the embodiment, the first heading mode and the second heading mode according to the disclosure are applied to an ink jet printer as an example of the recording apparatus, but these also can be applied to other liquid ejecting apparatuses in general.

Here, as the liquid ejecting apparatus, an ink jet type recording head is used, and the liquid ejecting apparatus is not limited to a recording apparatus such as a printer, a camera, or a facsimile, which executes recording a medium to be recorded by discharging ink from a recording head, and also includes an apparatus which attaches liquid to a medium to which the liquid is landed by ejecting the liquid corresponding to a use of the ink instead of ink from a liquid ejecting head corresponding to an ink jet type recording head to the medium to which the liquid is landed corresponding to the medium to be recorded.

As the liquid ejecting head, in addition to the recording head, a color material discharging head used for manufacturing a color filter such as a liquid crystal display, an electrode material (conductive paste) ejecting head used for forming an electrode such as an organic EL display or a surface emitting display (FED), a bioorganic material ejecting head used for manufacturing biochips, a sample ejecting head as a precision pipette, and the like are exemplified.

The disclosure is not limited to the examples described above, various modifications can be executed within the scope of the disclosure disclosed in the claims, and it is needless to say that the modifications are also included within the scope of the disclosure.

What is claimed is:

1. A recording apparatus comprising:

a recording head that includes a nozzle row which is provided with a plurality of liquid discharging nozzles discharging liquid to a medium along a medium transporting direction, and executes recording as one pass by discharging the liquid from the liquid discharging nozzles in accordance with movement in a scanning direction intersecting the medium transporting direction;

a transporting unit that transports the medium to a recording position which is a position facing the nozzle row; and a controller that is capable of acquiring information relating to a length of the medium in the medium transporting direction, and controls the recording head and the transporting unit, wherein the controller determines the liquid discharging nozzle being used for a recording operation as one pass in the beginning in accordance with the acquired length of the medium in the medium transporting direction, and executes a heading operation feeding the medium to a position facing the determined liquid discharging nozzle.

2. The recording apparatus according to claim 1, wherein, in the heading operation, the controller determines the number of the liquid discharging nozzles from an upstream side in the medium transporting direction of the nozzle row of the recording head.

3. The recording apparatus according to claim 2, further comprising:

a transportation load applying portion that applies transportation load to the medium in a medium transportation path on the upstream side by the transporting unit, wherein the controller is capable of selecting a first heading mode, and a second heading mode in which the number of the liquid discharging nozzles facing the medium by the first heading mode increases, as the heading operation, and wherein the second heading mode is a heading mode in which a rear end of the medium is transmitted through the transportation load applying portion in a case in which the rear end of the medium is determined to be caught by the transportation load applying portion when the first heading mode is selected.

4. The recording apparatus according to claim 3, wherein the recording operation as one pass in the beginning is a recording operation as one pass in the beginning in a recording mode in which recording as one pass by the recording head and feeding of the medium by the transporting unit are alternately executed, and contents of the recording are completed by executing the recording as the one pass at least once at positions of gaps between dots formed by the recording as the one pass in the beginning.

5. The recording apparatus according to claim 4, wherein the first heading mode is a mode in which medium faces the liquid discharging nozzles as the number obtained by dividing the number of the liquid discharging nozzles of the nozzle row in the medium transporting direction by n, and wherein the second heading mode is a mode in which the medium faces the liquid discharging nozzles more than the number obtained by dividing the number of the liquid discharging nozzles of the nozzle row in the medium transporting direction by n.

6. The recording apparatus according to claim 5, wherein the controller executes the second heading mode, and an amount of the medium fed by the transporting unit after recording as the one pass in the beginning is executed is close to an amount of the medium fed by the transporting unit after the first heading mode is executed.

7. The recording apparatus according to claim 3, wherein the transportation load applying portion includes a pair of rollers including by a feeding roller which feeds a medium, and a separating roller which nips the medium between the separating roller and the feeding roller and receives a rotational resistance.

8. The recording apparatus according to claim 3, wherein the transportation load applying portion includes a curved path through which the medium is bent and transported.

* * * * *